US011609518B2

(12) United States Patent
Sako

(10) Patent No.: US 11,609,518 B2
(45) Date of Patent: Mar. 21, 2023

(54) IMAGE HEATING APPARATUS

(71) Applicant: CANON KABUSHIKI KAISHA, Tokyo (JP)

(72) Inventor: Masato Sako, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/542,270

(22) Filed: Dec. 3, 2021

(65) Prior Publication Data

US 2022/0179339 A1 Jun. 9, 2022

(30) Foreign Application Priority Data

Dec. 9, 2020 (JP) ..... JP2020-204446

(51) Int. Cl.
*G03G 15/20* (2006.01)
*G03G 15/00* (2006.01)

(52) U.S. Cl.
CPC ..... *G03G 15/2039* (2013.01); *G03G 15/2017* (2013.01); *G03G 15/5004* (2013.01); *G03G 15/5045* (2013.01)

(58) Field of Classification Search
CPC ..... G03G 15/2039; G03G 15/2017; G03G 15/5004; G03G 15/5045
See application file for complete search history.

(56) References Cited

U.S. PATENT DOCUMENTS

2005/0175369 A1* 8/2005 Kinouchi ..... G03G 15/2042 399/69
2018/0032008 A1* 2/2018 Sako ..... G03G 15/2039

FOREIGN PATENT DOCUMENTS

JP 2014059508 A 4/2014
JP 2016139003 A 8/2016
JP 2020091495 A 6/2020
JP 2020177088 A 10/2020

* cited by examiner

*Primary Examiner* — Clayton E. LaBalle
*Assistant Examiner* — Michael A Harrison
(74) *Attorney, Agent, or Firm* — Canon U.S.A., Inc. IP Division

(57) ABSTRACT

A control unit controls power to be supplied to a common power supply path in a first period, using a selected first temperature detection member, and controls power to be supplied to the common power supply path in a second period, using a selected second temperature detection member. The first temperature detection member has a higher detected temperature than that of the second temperature detection member, and in the second period, the first detected temperature and the second detected temperature fall within a temperature range between a first temperature and a second temperature lower than the first temperature.

12 Claims, 16 Drawing Sheets

IMAGE HEATING APPARATUS

BACKGROUND

Field

The present disclosure relates to an image heating apparatus such as a fixing device included in an electrophotographic recording type image forming apparatus such as a copy machine and a printer.

Description of the Related Art

As an image heating apparatus included in an image forming apparatus that uses an electrophotographic system or an electrostatic recording system, there is an apparatus including a fixing film, a heater, which is in contact with the inner surface of the fixing film, and a roller that forms a nip portion together with the heater via the fixing film. If an image forming apparatus including the image heating apparatus continuously performs image formation using recording materials having a size narrower than the maximum passable width in a direction orthogonal to a recording material conveyance direction (hereinafter, referred to as a longitudinal direction), a so-called sheet non-passing portion temperature rise occurs. More specifically, the sheet non-passing portion temperature rise is a phenomenon in which the temperature of each part gradually rises in a region (hereinafter, referred to as a sheet non-passing portion) of the nip portion through which a recording material does not pass in the longitudinal direction. The image heating apparatus needs to control the temperature of the sheet non-passing portion not to exceed a heatproof temperature of each member in the apparatus.

For this reason, a method of suppressing a sheet non-passing portion temperature rise by decreasing throughput (the number of printable sheets per minute) of continuous print (hereinafter, referred to as throughput down) is often used.

On the other hand, a method is discussed in Japanese Patent Application Laid-Open No. 2014-59508 as one of methods of suppressing a sheet non-passing portion temperature rise without decreasing throughput as far as possible. The method discussed in Japanese Patent Application Laid-Open No. 2014-59508 is a method of dividing a heating block including a set of a conductive element and a heating element, at a position corresponding to the size of a recording material in a heater longitudinal direction, and independently controlling power to be supplied to each divided heating block.

It is possible to suppress a sheet non-passing portion temperature rise by avoiding power supply to a heating block corresponding to a sheet non-passing portion in the heater longitudinal direction unless necessary. In an image heating apparatus having such a configuration, supplied power to two or more heating blocks is sometimes collectively controlled by electrically connecting the two or more heating blocks to a common power supply path.

However, even if power is collectively supplied to two or more heating blocks, heat generation amounts may be different between the heating blocks in some cases. At this time, in the case of collectively controlling power supply to two or more heating blocks, it is required to control supplied power in consideration of a heat generation amount of each heating block.

SUMMARY

According to a first embodiment of the present disclosure, an image heating apparatus for heating an image formed on a recording material includes a heater in which a plurality of heating blocks including a first heating block and a second heating block is arranged in a direction orthogonal to a conveyance direction of a recording material, a first temperature detection member configured to detect a temperature of the first heating block, a second temperature detection member configured to detect a temperature of the second heating block, and a control unit configured to control power supply to the plurality of heating blocks, wherein the first heating block and the second heating block are electrically connected to a common power supply path, wherein the control unit controls power to be supplied to the common power supply path, based on a first detected temperature detected by the first temperature detection member or a second detected temperature detected by the second temperature detection member, and wherein, in a case where a period from a start of power supply to the common power supply path until one of the first detected temperature and the second detected temperature reaches a first temperature is defined as a first period, and a period for the heater heating a recording material that is later than the first period is defined as a second period, the control unit controls power to be supplied to the common power supply path in the first period, using the selected first temperature detection member, and controls power to be supplied to the common power supply path in the second period, using the selected second temperature detection member, the first temperature detection member has a higher detected temperature than that of the second temperature detection member, and, in the second period, the first detected temperature and the second detected temperature fall within a temperature range between the first temperature and a second temperature lower than the first temperature.

According to a second embodiment of the present disclosure, an image heating apparatus for heating an image formed on a recording material, includes a heater in which a plurality of heating blocks including a first heating block and a second heating block is arranged in a direction orthogonal to a conveyance direction of a recording material, a first temperature detection member configured to detect a temperature of the first heating block, a second temperature detection member configured to detect a temperature of the second heating block, and a control unit configured to control power supply to the plurality of heating blocks, wherein the first heating block and the second heating block are electrically connected to a common power supply path, wherein the control unit controls power to be supplied to the common power supply path, and wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on the first detected temperature, and controls power to be supplied to the common power supply path in the second period, based on information regarding a temperature difference between the first detected temperature and a second detected temperature detected by the second temperature detection member, and the first detected temperature, and, in the second period, the first detected temperature and the second detected temperature fall within a temperature range between the first temperature and a second temperature lower than the first temperature.

According to a third embodiment of the present disclosure, an image heating apparatus for heating an image formed on a recording material, includes a heater in which a plurality of heating blocks including a first heating block and a second heating block is arranged in a direction orthogonal to a conveyance direction of a recording material, a first temperature detection member configured to detect a temperature of the first heating block, a second temperature detection member configured to detect a temperature of the second heating block, and a control unit configured to control power supply to the plurality of heating blocks, wherein the first heating block and the second heating block are electrically connected to a common power supply path, wherein the control unit controls power to be supplied to the common power supply path, and wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on information regarding a temperature difference between the first detected temperature and a second detected temperature detected by the second temperature detection member, and the second detected temperature, and controls power to be supplied to the common power supply path in the second period, based on the second detected temperature, and, in the second period, the second detected temperature falls within a temperature range between the first temperature and a second temperature lower than the first temperature.

Further features of the present disclosure will become apparent from the following description of example embodiments with reference to the attached drawings.

DESCRIPTION OF THE EMBODIMENTS

Hereinafter, example embodiments of the present disclosure will be described with reference to the drawings. The following example embodiments are not intended to limit the invention set forth in the appended claims. In addition, not all the combinations of features described in the example embodiments are essential to every embodiment of the present invention.

1. Configuration of Image Forming Apparatus

Figure 1:
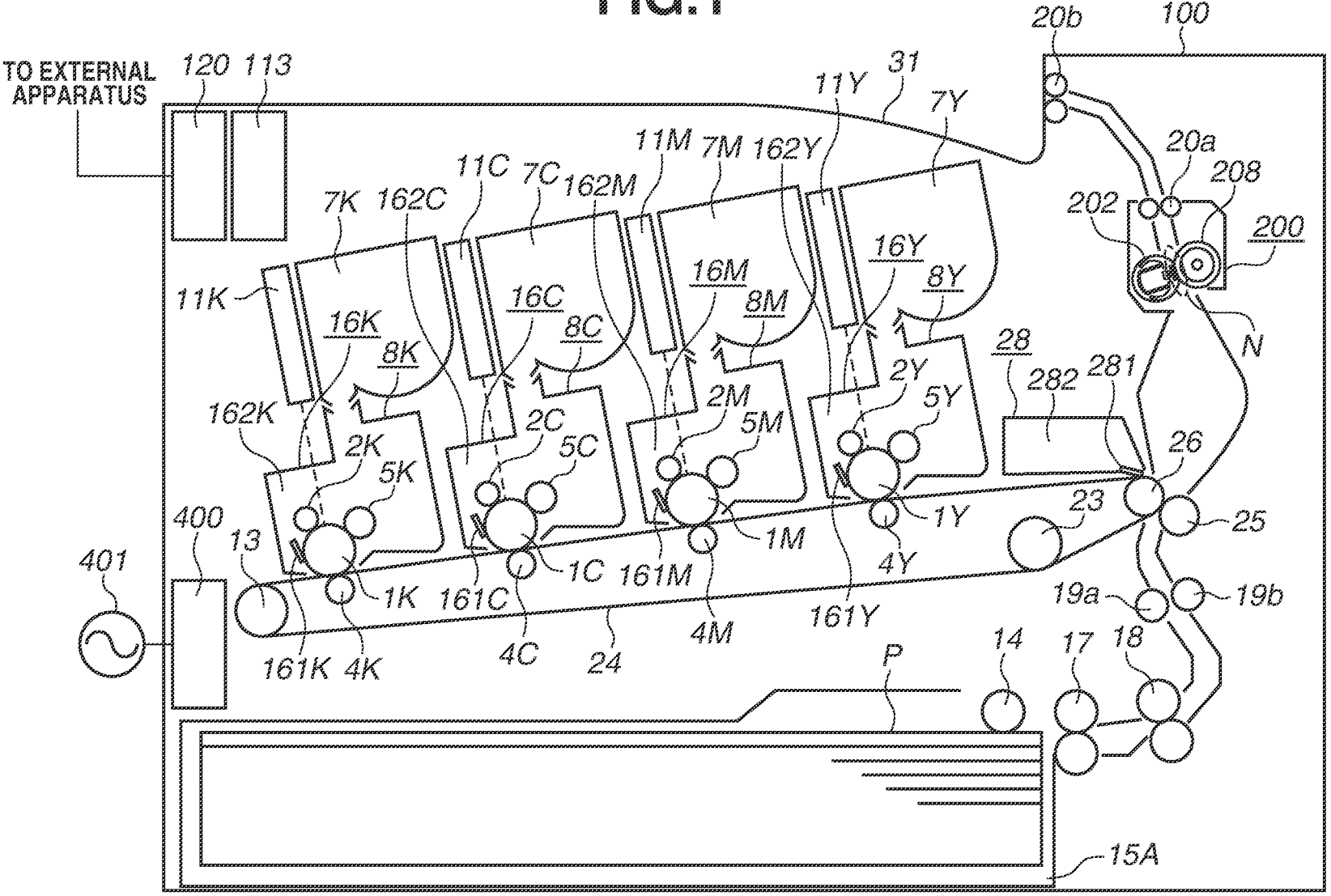
FIG. 1 is a schematic configuration diagram of an image forming apparatus according to a first example embodiment.

FIG. 1 is a schematic configuration diagram of an image forming apparatus 100 according to a first example embodiment. As an example, the image forming apparatus 100 is an electrophotographic full-color printer employing an intermediate transfer system. The image forming apparatus 100 includes four image forming stations for forming yellow, magenta, cyan, and black images. These four image forming stations are arranged in a line at regular intervals. In the following description, alphabetical letters Y, M, C, and K added to the ends of reference numerals respectively indicate that corresponding members are members for forming yellow (Y), magenta (M), cyan (C), and black (K) toner images. When there is no need to make a discrimination between colors in the following description, reference numerals without the alphabetical letters Y, M, C, and K, are used.

The image forming apparatus 100 includes a video controller 120 and an engine controller 113. The video controller 120 functions as an acquisition unit that acquires information regarding an image formed on a recording material. The video controller 120 receives and processes image information and a print instruction transmitted from an external apparatus such as a personal computer. The engine controller 113 is connected with the video controller 120, and controls each component included in the image forming apparatus 100, in response to an instruction from the video controller 120. If the video controller 120 receives a print instruction from an external apparatus, the video controller 120 transmits a start instruction of image formation (hereinafter, also referred to as a print start command) to the engine controller 113. If the print start command is transmitted from the video controller 120, power supply to an image heating apparatus 200 and the driving of an exposure scanner unit 11 are started. Recording materials P are fed one by one from a sheet feeding cassette 15A by a pickup roller 14 and sheet feeding rollers 17 and 18. For synchronizing a toner image forming operation onto an intermediate transfer belt 24 to be described below, with a conveyance operation of the recording material P, the recording material P is nipped by a conveyance (registration) roller 19*a* and a conveyance (registration) counter roller 19*b*, and the conveyance is temporarily stopped.

Subsequently, an image forming operation onto the intermediate transfer belt 24 (endless belt) will be described. A photosensitive drum 1 includes an organic photoconductive layer on a substrate on the drum, and is rotationally driven by a driving device (not illustrated) at a predetermined process speed. The process speed corresponds to a circumferential speed (surface moving speed) of the photosensitive drum 1. A charging roller 2 uniformly charges the photosensitive drum 1 to a predetermined potential. The exposure scanner unit 11 includes a reflection mirror and a laser diode (light emitting element), and exposes the surface of the photosensitive drum 1 to light by emitting laser light corresponding to image information.

An electrostatic latent image corresponding to image information is thereby formed on the surface of the photosensitive drum 1. A developing device 8 develops the electrostatic latent image as a toner image by a development roller 5 causing toner to adhere to the electrostatic latent image formed on the surface of the photosensitive drum 1. A primary transfer roller 4 primarily transfers the image formed on the photosensitive drum 1, onto the intermediate transfer belt 24. The intermediate transfer belt 24 will also be referred to as a rotary member. The intermediate transfer belt 24 is driven by a driving roller 26 and driven rollers 13 and 23. The driving roller according to the present example embodiment may be any of the rollers 26, 13, and 23. Toner remaining on the photosensitive drum 1 after primary transfer is removed and collected from the surface of the photosensitive drum 1 by a drum cleaner 16 provided in contact with the photosensitive drum 1. The drum cleaner 16 includes a cleaner blade 161 and a toner collecting container 162. The above-described components from the photosensitive drum 1 to the drum cleaner 16 that are related to the toner image formation onto the intermediate transfer belt 24 will also be referred to as an image forming unit, and an operation performed by the image forming unit will also be referred to as an image forming operation.

The toner image primarily transferred onto the intermediate transfer belt 24 is conveyed to a secondary transfer nip portion formed by a secondary transfer roller 25 and the driving roller 26. At the same time, the recording material P nipped by the conveyance rollers 19*a* and 19*b* and temporarily stopped without being conveyed is also conveyed to the secondary transfer nip portion. Then, by a secondary transfer bias applied to the secondary transfer roller 25, the toner image primarily transferred onto the intermediate transfer belt 24 is secondarily transferred onto the recording material P. Then, heat and pressure are applied to the recording material P by a fixing device (image heating apparatus) 200 serving as a fixing unit (image heating unit), and the toner image secondarily transferred onto the recording material P is thermally fixed onto the recording material P. Power is supplied to the image heating apparatus 200 by a control circuit 400 (control unit) connected to a commercial alternating current power source 401. The recording material P with the toner image fixed is discharged to a sheet discharge tray 31 by discharge rollers 20*a* and 20*b*, and the image forming operation onto the recording material P ends. A belt cleaner 28 cleans, using a cleaner blade 281, toner remaining on the intermediate transfer belt 24 after secondary transfer. The collected toner is stored in a cleaner container 282 as waste toner.

In the present example embodiment, an image forming apparatus having a 216-mm maximum passable width in a direction orthogonal to a conveyance direction of the recording material P is used, and the image forming apparatus can execute printing onto a recording material having a LETTER size (216 mm×279 mm).

2. Configuration of Image Heating Apparatus

Figure 2:
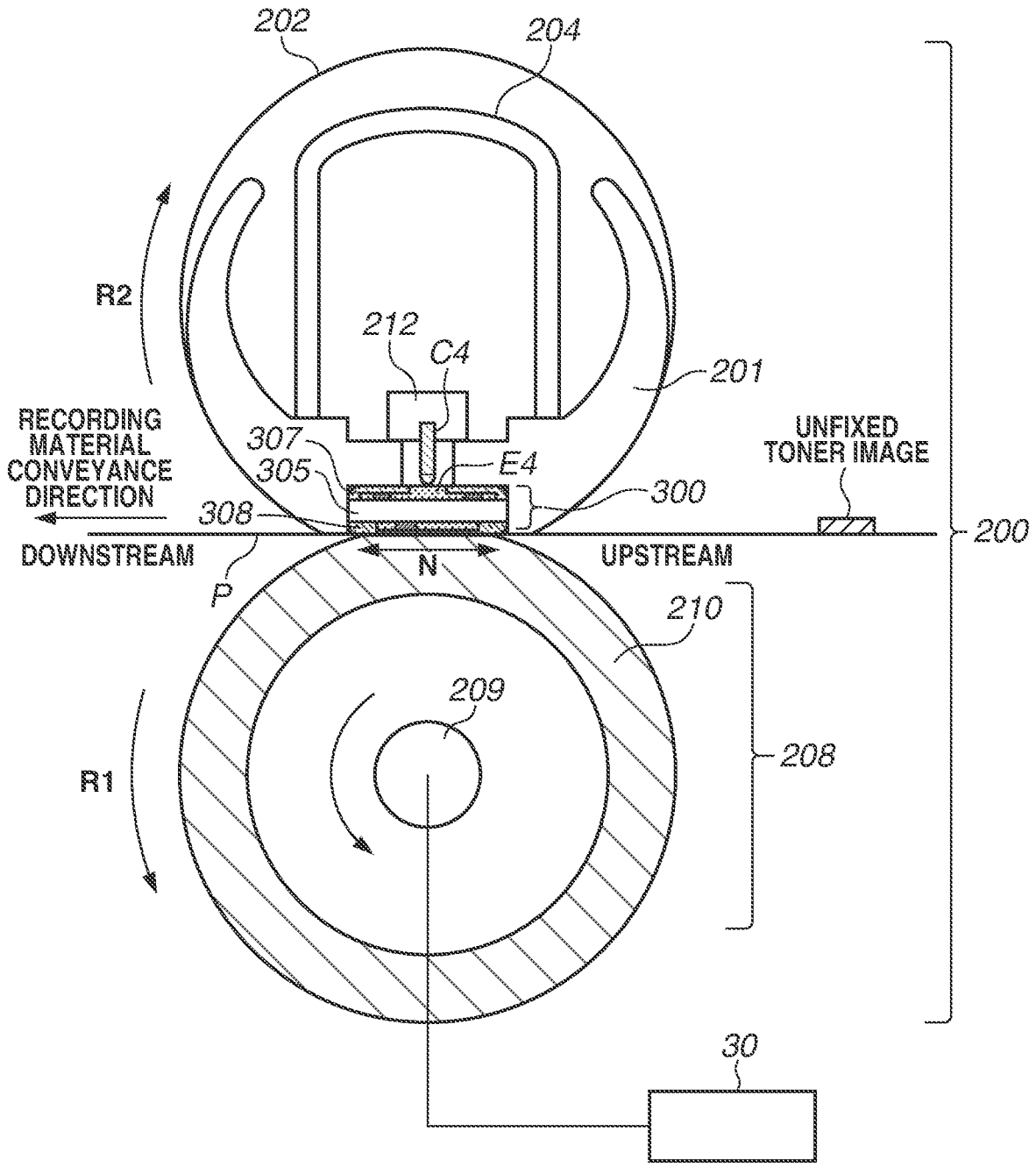
FIG. 2 is a schematic configuration diagram of an image heating apparatus according to the first example embodiment.

FIG. 2 is a schematic configuration diagram of the image heating apparatus 200 according to the present example embodiment. The image heating apparatus 200 includes a fixing film 202 serving as an endless belt, a heater 300 (heating unit), which is in contact with the inner surface of the fixing film 202, a pressure roller 208 that forms a fixing nip portion N by contacting the outer circumferential surface of the fixing film 202, and a metal stay 204.

The fixing film 202 is a multilayered heat-resistant film formed into a cylindrical shape, and includes heat-resistant resin such as polyimide, or metal such as stainless as a base layer. For preventing toner from adhering to the fixing film 202 and ensuring separability from the recording material P, a release layer is formed on the surface of the fixing film 202 by covering the surface with heat-resistant resin such as tetrafluoroethylene-perfluoroalkyl vinyl ether copolymer (PFA) that has high releasability. Furthermore, a heat-resisting rubber such as a silicone rubber may be formed as an elastic layer between the above-described base layer and the release layer for improving image quality.

The pressure roller 208 includes a metal core 209 made of material such as iron or aluminum, and an elastic layer 210 made of material such as silicone rubber. Similar to the fixing film 202, a release layer may be formed on the surface of the pressure roller 208.

The heater 300 is held by a heater holding member 201 made of heat-resistant resin, and heats the fixing film 202 by heating the fixing nip portion N using a heating element provided on a substrate 305 made of ceramic. The details of the heater 300 will be described below. The heater holding member 201 also has a guide function of guiding the rotation of the fixing film 202. The heater 300 includes an electrode E provided on an opposite side (back surface side) of the side that contacts the inner surface of the fixing film 202, and power is supplied to the electrode E at an electric contact C. FIG. 2 illustrates an electrode E4 as an example of the electrode E, and an electric contact C4 as an example of the electric contact C. The metal stay 204 presses the heater holding member 201 toward the pressure roller 208 by receiving pressing force from a pressing member (not illustrated). In addition, a safety element 212 such as a thermoswitch or a temperature fuse for blocking power to be supplied to the heater 300, by operating in response to abnormal heat generation of the heater 300 is arranged facing the back surface of the heater 300.

The pressure roller 208 rotates in an arrow R1 direction by receiving driving force from a motor 30. By the pressure roller 208 rotating, the fixing film 202 rotates in an arrow R2 direction following the rotation. By applying heat of the fixing film 202 to the recording material P while nipping and conveying the recording material P at the fixing nip portion N, an unfixed toner image on the recording material P is fixed.

3. Configuration of Heater

Figure 3A:
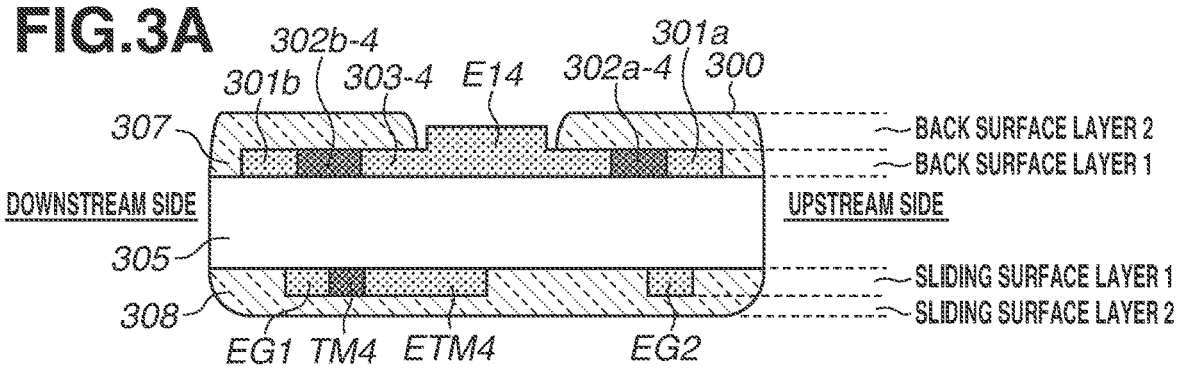
FIGS. 3A and 3B are configuration diagrams of a heater according to the first example embodiment.
Figure 3B:
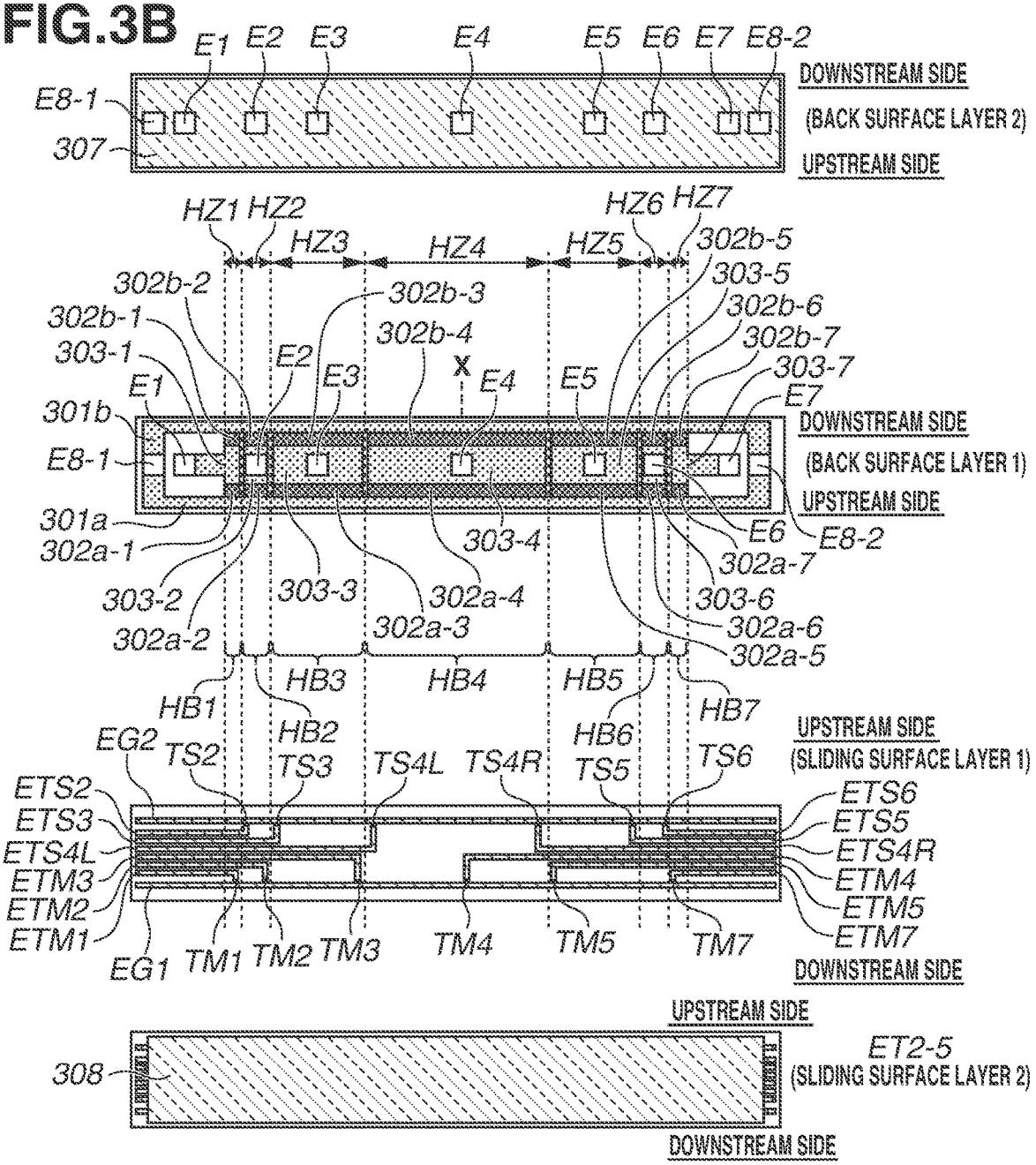

FIGS. 3A and 3B are configuration diagrams of the heater 300 according to the present example embodiment. FIG. 3A is a cross-sectional view of the heater 300, and FIG. 3B is a plan view of each layer of the heater 300. FIG. 3B illustrates the recording material P in the image forming apparatus 100 according to the present example embodiment. The conveyance according to the present example embodiment is conducted with respect to the center. The recording material P is conveyed in such a manner that a center line in the direction orthogonal to the conveyance direction passes through a conveyance reference position X. FIG. 3A is a cross-sectional view of the heater 300 at the conveyance reference position X.

The heater 300 is arranged in an internal space of the fixing film 202. The heater 300 includes the substrate 305 made of ceramic, a back surface layer 1 provided on the substrate 305, a back surface layer 2 covering the back surface layer 1, a sliding surface layer 1 provided on the surface of the substrate 305 on the opposite side of the back surface layer 1, and a sliding surface layer 2 covering the sliding surface layer 1.

The back surface layer 1 includes first conductive elements 301 (301*a* and 301*b*) provided along the longitudinal direction of the heater 300. The first conductive elements 301 are separated into the first conductive element 301*a* and the first conductive element 301*b*. The first conductive element 301*b* is arranged on the substrate on the downstream side of the first conductive element 301*a* in the conveyance direction of the recording material P. The back surface layer 1 also includes second conductive elements 303 (303-1 to 303-7) provided parallel to the first conductive element 301*a* and the first conductive element 301*b*. The second conductive elements 303 are provided along the longitudinal direction of the heater 300 between the first conductive element 301*a* and the first conductive element 301*b*. The back surface layer 1 further includes heating elements 302*a* (302*a*-1 to 302*a*-7) and heating elements 302*b* (302*b*-1 to 302*b*-7), which are heating resistive elements that generate heat when power is supplied thereto. The heating elements 302*a* are provided between the first conductive element 301*a* and the second conductive elements 303, and generate heat when power is supplied thereto via the first conductive element 301*a* and the second conductive elements 303. The heating elements 302*b* are provided between the first conductive element 301*b* and the second conductive elements 303, and generate heat when power is supplied thereto via the first conductive element 301*b* and the second conductive elements 303.

A heating portion including the first conductive elements 301, the second conductive elements 303, the heating elements 302*a*, and the heating elements 302*b* is divided into seven heating blocks (HB1 to HB7) in the longitudinal direction of the heater 300. More specifically, the heating elements 302*a* are divided into seven regions corresponding to the heating elements 302*a*-1 to 302*a*-7, in the longitudinal direction of the heater 300. The heating elements 302*b* are divided into seven regions corresponding to the heating elements 302*b*-1 to 302*b*-7, in the longitudinal direction of the heater 300. Furthermore, the second conductive elements 303 are divided into seven regions of the conductive elements 303-1 to 303-7, corresponding to the divided positions of the heating elements 302*a* and 302*b*. The respective heat generation amounts of the seven heating blocks (HB1 to HB7) are individually controlled by power supply amounts to heating resistive elements in the respective blocks, which are individually controlled.

A heating range according to the present example embodiment is a range from the left end in FIG. 3B of the heating block HB1 to the right end in FIG. 3B of the heating block HB7, and a range heated by the heating range is divided into seven heated regions (HZ1 to HZ7). The total length from the left end in FIG. 3B of the heated region HZ1 to the right end in FIG. 3B of the heated region HZ7 among the seven heated regions is 216 mm, and corresponds to a LETTER size width. A length from the left end in FIG. 3B of the heated region HZ2 to the right end in FIG. 3B of the heated region HZ6 is 210 mm, and corresponds to an A4 size width. A length from the left end in FIG. 3B of the heated region HZ3 to the right end in FIG. 3B of the heated region HZ5 is 182 mm, and corresponds to a B5 size width. A length from the left end in FIG. 3B to the right end in FIG. 3B of the heated region HZ4 is 105 mm, and corresponds to an A6 size width.

The back surface layer 1 further includes the electrodes E (E1 to E7, E8-1, and E8-2). The electrodes E1 to E7 are respectively provided in the regions of the conductive elements 303-1 to 303-7, and are electrodes for respectively supplying power to the heating blocks HB1 to HB7 via the conductive elements 303-1 to 303-7. The electrodes E8-1 and E8-2 are electrodes for supplying power to the heating blocks HB1 to HB7 via the first conductive element 301*a* and the first conductive element 301*b* at the end portions in the longitudinal direction of the heater 300. In the present example embodiment, the electrodes E8-1 and E8-2 are provided at the both ends in the longitudinal direction of the heater 300, but only the electrode E8-1, for example, may be provided on one side (i.e., the electrode E8-2 is not provided). Power is supplied to the first conductive elements 301*a* and 301*b* from a common electrode, but respective electrodes may be provided for the first conductive elements 301*a* and 301*b*, and power supply may be individually performed.

The back surface layer 2 includes a surface protective layer 307 (glass in the present example embodiment) having insulation properties, and covers the first conductive elements 301, the second conductive elements 303, and the heating elements 302*a* and 302*b*. The surface protective layer 307 is formed excluding the position of the electrode E, and has a configuration in which the electric contact C can be connected to the electrode E from the back surface layer 2 side of the heater 300.

The sliding surface layer 1 is provided on the surface of the substrate 305 that is on the opposite side of the surface on which the back surface layer 1 is provided. The sliding surface layer 1 includes main thermistors (control temperature detection units) TM1 to TM5, and TM7, and sub thermistors TS2 to TS6 as detection elements for detecting the temperatures of the heating blocks HB1 to HB7. The roles of the main thermistors and the sub thermistors will be described below. The thermistors TM include a material having a positive temperature coefficient (PTC) property or a negative temperature coefficient (NTC) property (NTC property in the present example embodiment), and can detect the temperatures of all the heating blocks by detecting their resistance values. From the aspect of the arrangement space and the cost, a main thermistor is not arranged in the heated region HZ6 in the present example embodiment.

The sliding surface layer 1 also includes conductive elements ETM (ETM1 to ETM5, ETM7) for supplying power to the main thermistors TM and detecting their resistance values. The sliding surface layer 1 further includes conductive elements ETS (ETS2 to ETS6) for supplying power to the sub thermistors TS and detecting their resistance values. The conductive elements ETM1 to ETM5, and ETM7 are respectively connected to the main thermistors TM1 to TM5, and TM7, and the conductive elements ETS2 to ETS6 are respectively connected to the sub thermistors TS2 to TS6. A conductive element EG1 is connected to the six main thermistors TM1 to TM5, and TM7, and forms a common conductive path. A conductive element EG2 is connected to the six sub thermistors TS2, TS3, TS4L, TS4R, TS5, and TS6, and forms a common conductive path. The conductive elements ETM, the conductive elements ETS, and the conductive elements EG are formed up to longitudinal direction end portions along the longitudinal direction of the heater 300, and connected with the control circuit 400 to be described below, via an electric contact (not illustrated) at the heater longitudinal direction end portion.

The sliding surface layer 2 includes a surface protective layer 308 (glass in the present example embodiment) having sliding and insulating properties. The surface protective layer 308 covers the main thermistors TM, the sub thermistors TS, the conductive elements ETM, the conductive elements ETS, and the conductive elements EG, and ensures sliding properties with respect to the inner surface of the fixing film 202. The surface protective layer 308 is formed excluding the longitudinal direction both end portions of the heater 300 for providing electric contacts for the conductive elements ETM, the conductive elements ETS, and the conductive elements EG.

Subsequently, a method of connecting the electric contact C to each electrode E will be described. The heater holding member 201 includes through-holes provided at positions corresponding to electrodes E (E1 to E7, E8-1, and E8-2). At the through-hole positions, electric contacts C (C1 to C7, C8-1, and C8-2) are electrically connected to the electrodes E (E1 to E7, E8-1, and E8-2) by a method such as pressing using a spring or welding. The electric contact C is connected with the control circuit 400 of the heater 300, which will be described below, via a conductive member (not illustrated) provided between the metal stay 204 and the heater holding member 201.

4. Configuration of Heater Control Circuit

Figure 4:
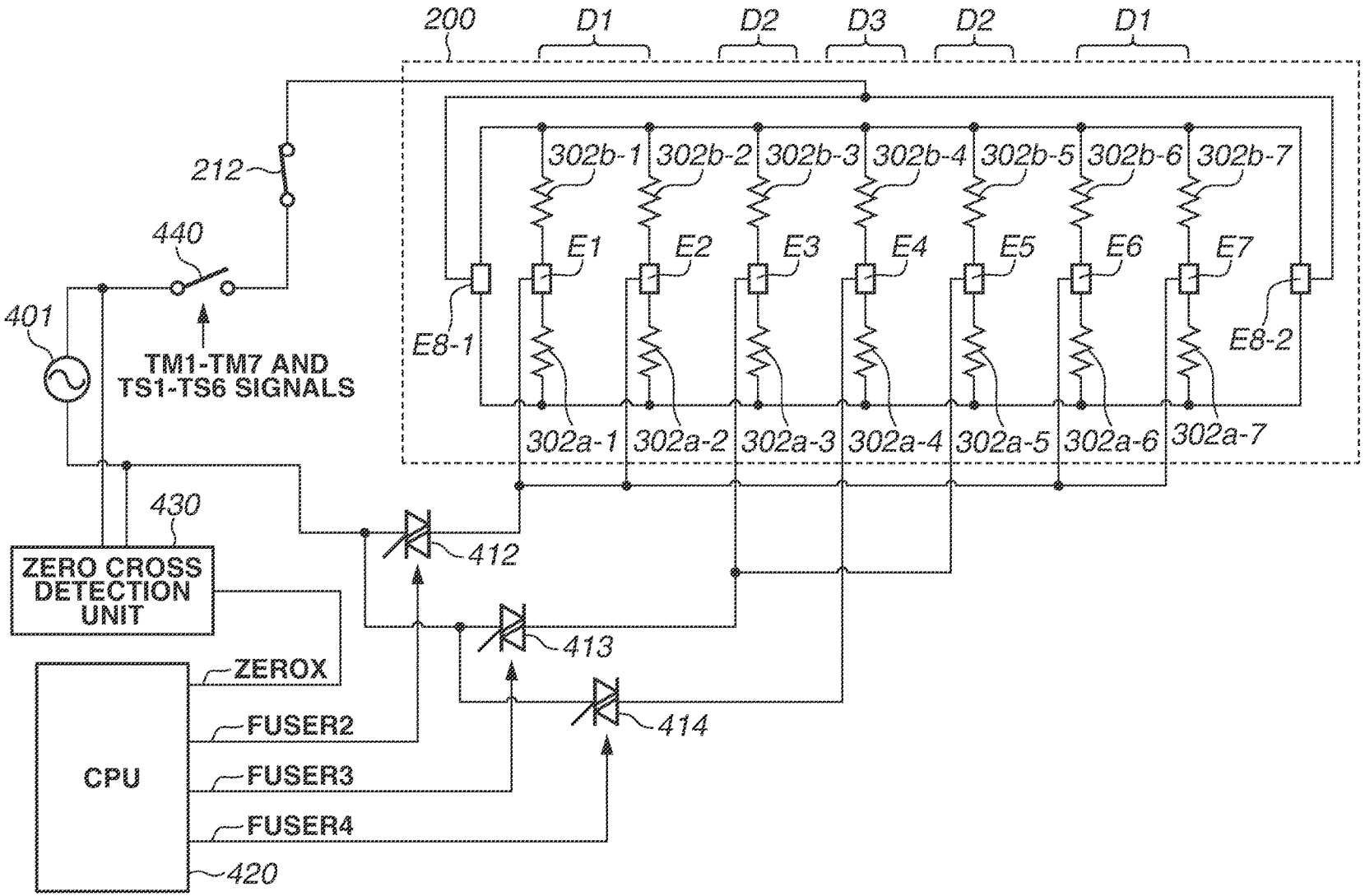
FIG. 4 is a control circuit diagram of the heater according to the first example embodiment.

FIG. 4 is a circuit diagram of the control circuit 400 of the heater 300 according to the present example embodiment. The commercial alternating current power source 401 is connected to the image forming apparatus 100 according to the present example embodiment. The power control of the heater 300 is performed by supplying/blocking power by triodes for alternating current (TRIACs) (power supply units) 412 to 414. The TRIACs 412 to 414 operate in response to FUSER2 to FUSER4 signals from a central processing unit (CPU) 420. The illustration of driving circuits of the TRIACs 412 to 414 is omitted. The control circuit 400 of the heater 300 has a circuit configuration in which the seven heating blocks HB1 to HB7 can be independently controlled by the three TRIACs 412 to 414. By selectively controlling the TRIACs 412 to 414, it is possible to selectively control power supply to a plurality of heating elements, and selectively and individually heat a plurality of heated regions divided in the longitudinal direction. The TRIAC 412 controls power supply to the heating blocks HB1, HB2, HB6, and HB7. A group of the heating blocks HB1, HB2, HB6, and HB7 of which power supply is controlled by the TRIAC 412 will also be referred to as a drive D1. The TRIAC 413 controls power supply to the heating blocks HB3 and HB5. A group of the heating blocks HB3 and HB5 of which power supply is controlled by the TRIAC 413 will also be referred to as a drive D2. The TRIAC 414 controls power supply to the heating block HB4. A group of the heating block HB4 of which power supply is controlled by the TRIAC 414 will also be referred to as a drive D3. The drives D1 and D2 each serve as the same driving group that drives two or more heating blocks by one TRIAC.

A zero cross detection unit 430 is a circuit that detects zero cross of the commercial alternating current power source 401, and outputs a ZEROX signal to the CPU 420. The ZEROX signal is used for detecting the timing of phase control or wavenumber control of the TRIACs 412 to 414.

A relay 440 serving as a power blocking unit blocks power to the heater 300 in a case where the temperature of the heater 300 excessively rises due to a breakdown or the like, and any of the main thermistors TM1 to TM7 and the sub thermistors TS2 to TS6 detects a temperature Ter [° C.], which is an excessive temperature rise threshold. The excessive temperature rise threshold Ter [° C.] is a temperature having a predetermined margin with respect to a temperature at which heater breakage occurs due to thermal stress applied at the time of an excessive temperature rise. In the present example embodiment, Ter=300° C. is set.

In internal processing of the CPU 420, based on a control target temperature $TGT_i$ (i=1 to 3) of each drive and a detected temperature of a main thermistor, power to be supplied is calculated by proportional integral control (PI control), for example. Furthermore, the power to be supplied is converted into a control level (duty ratio) of a phase angle (phase control) and a wavenumber (wavenumber control) corresponding to the power, and the TRIACs 412 to 414 are controlled by the control condition.

More specifically, in the drive D1, control is performed based on a control target temperature TGT1 and a detected temperature of any of the main thermistors TM1, TM2, and TM7. In the drive D2, control is performed based on a control target temperature TGT2 and a detected temperature of any of the main thermistors TM3 and TM5. In the drive D3, control is performed based on a control target temperature TGT3 and a detected temperature of the main thermistor TM4.

If the control target temperatures TGT1 to TGT3 become too high, power supply might be blocked by the relay 440 due to an excessive temperature rise. Thus, a temperature Tlim lower than the excessive temperature rise threshold Ter is provided as an upper limit target temperature. In the present example embodiment, the upper limit target temperature Tlim is set to a temperature of 280° C. having a margin of 20° C. with respect to the excessive temperature rise threshold Ter (=300° C.).

In the present example embodiment, the sub thermistors TS2 to TS6 are not used to control supplied power to each drive. These thermistors are used for the detection of the above-described excessive temperature rise and the detection of a sheet non-passing portion temperature rise. The sheet non-passing portion temperature rise is a phenomenon in which, in a case where a position of an end portion in a direction orthogonal to the conveyance direction of the recording material P does not coincide with a divided position of the heated regions HZ1 to HZ7, for example, a temperature rise occurs in a heating block corresponding to a region of the heated regions through which a sheet does not pass.

5. Heated Region and Fixing Film

Figure 5:
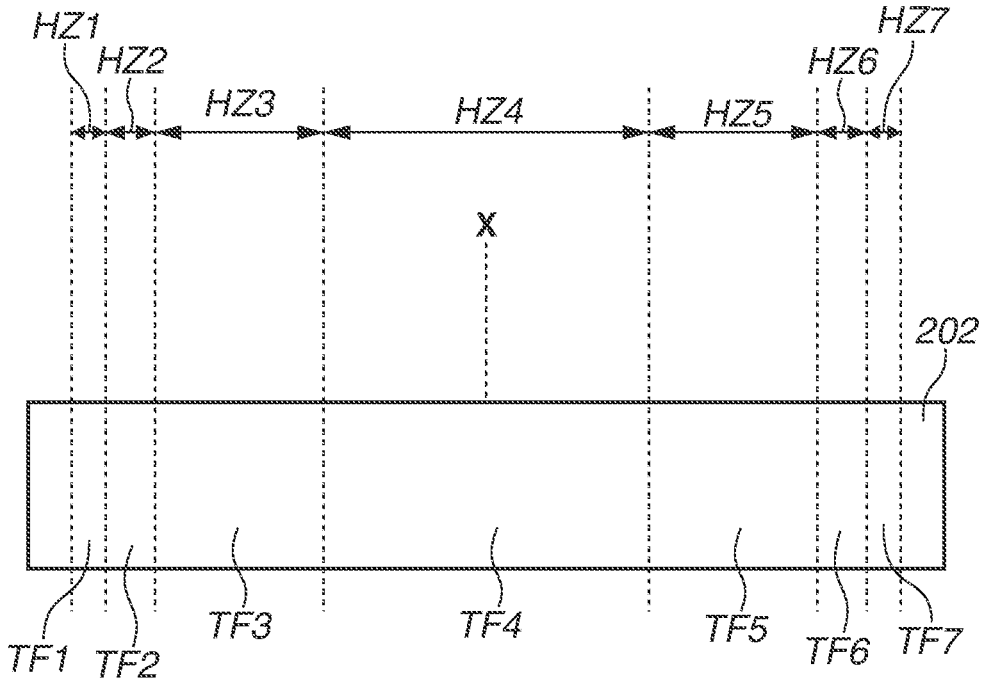
FIG. 5 is a relationship diagram of heated regions and a fixing film according to the first example embodiment.

FIG. 5 is a diagram illustrating a positional relationship in the longitudinal direction between the heated regions HZ1 to HZ7 and the fixing film 202 according to the present example embodiment. Regions of the fixing film 202 that correspond to the heated regions HZ1 to HZ7 will also be respectively referred to as regions TF1 to TF7.

6. Heater Control Method

When the image heating apparatus 200 is started up, it is desirable to rise the temperature of the fixing film 202 into the range of a fixing temperature margin as quickly as possible. On the other hand, when the recording material P passes through the fixing nip portion N, it is desirable to keep the temperature of the fixing film 202 within the range of the fixing temperature margin.

For this reason, the temperature control of the fixing film 202 is sometimes varied by the control unit between a start-up mode and a sheet passing mode. At this time, the start-up mode is a control mode to be set in a period from the start of power supply to the heating block HB until a detected temperature of any of the main thermistors TM in the same driving group reaches a first temperature. The start-up mode corresponds to a preparation period for heating a recording material by a heater, and this period will also be referred to as a first period. The first temperature used at this time will be described below. The sheet passing mode is a control mode to be set after the detected temperature of any of the main thermistors TM in the same driving group reaches the first temperature. In the sheet passing mode, a period in which a recording material is heated by the heater will also be referred to as a second period. The fixing temperature margin will be described below.

In the present example embodiment, as an example of a common power supply path to be controlled by the control circuit 400, the drive D2 of which power supply is controlled by controlling the TRIAC 413 will be described. In the drive D2 according to the present example embodiment, resistance values differ between the heating block HB5 and the heating block HB3, and a resistance value of the heating block HB5 is smaller than a resistance value of the heating block HB3. At this time, a heat generation amount of the heating block HB5 is larger than a heat generation amount of the heating block HB3. The case of executing the temperature control using only the main thermistor TM5 as a reference thermistor when supplied power to the heating block HB5 and the heating block HB3 is collectively controlled without considering a variation in resistance value between the heating blocks in this state will be described with reference to FIGS. 6A and 6B. The case of executing the temperature control using only the main thermistor TM3 as a reference thermistor when similar control is performed will be described with reference to FIGS. 7A and 7B. The heating block HB5 and the heating block HB3 will also be respectively referred to as a first heating block and a second heating block. The main thermistor TM5 and the main thermistor TM3 will also be respectively referred to as a first temperature detection member and a second temperature detection member. A temperature detected by the first temperature detection member will also be referred to as a first detected temperature, and the temperature detected by the second temperature detection member will also be referred to as a second detected temperature.

Figure 6A:
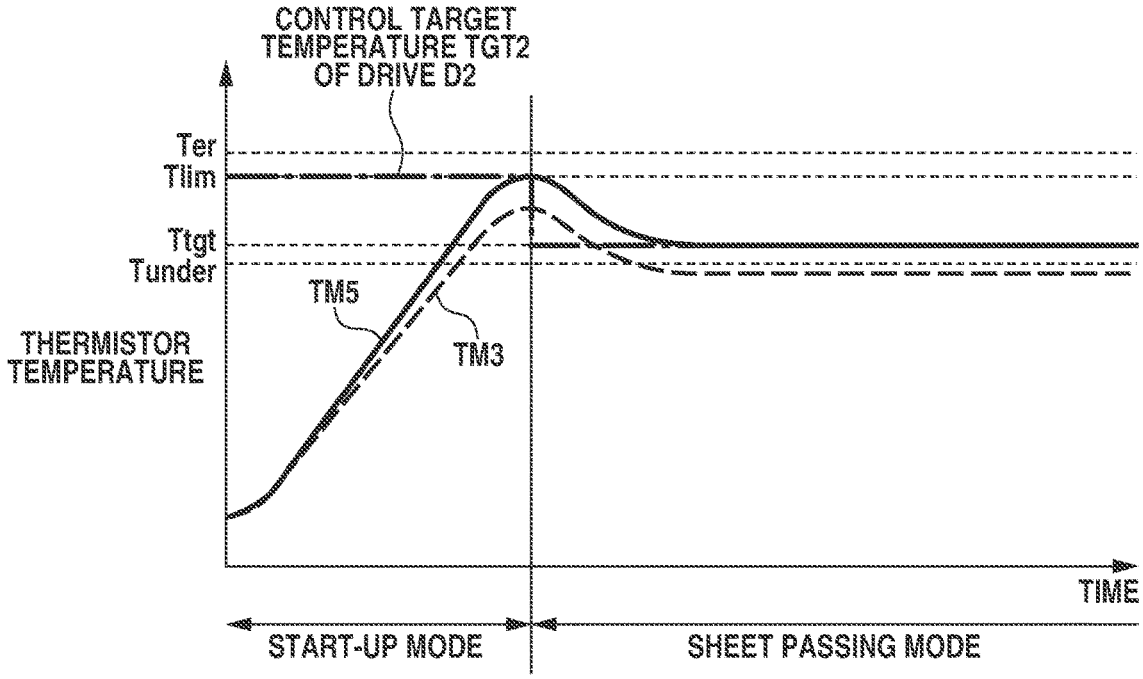
FIGS. 6A and 6B illustrate temperature transition caused in a case where heater control is executed using a reference thermistor as a main thermistor without considering a variation in heat generation amount according to the first example embodiment.
Figure 6B:
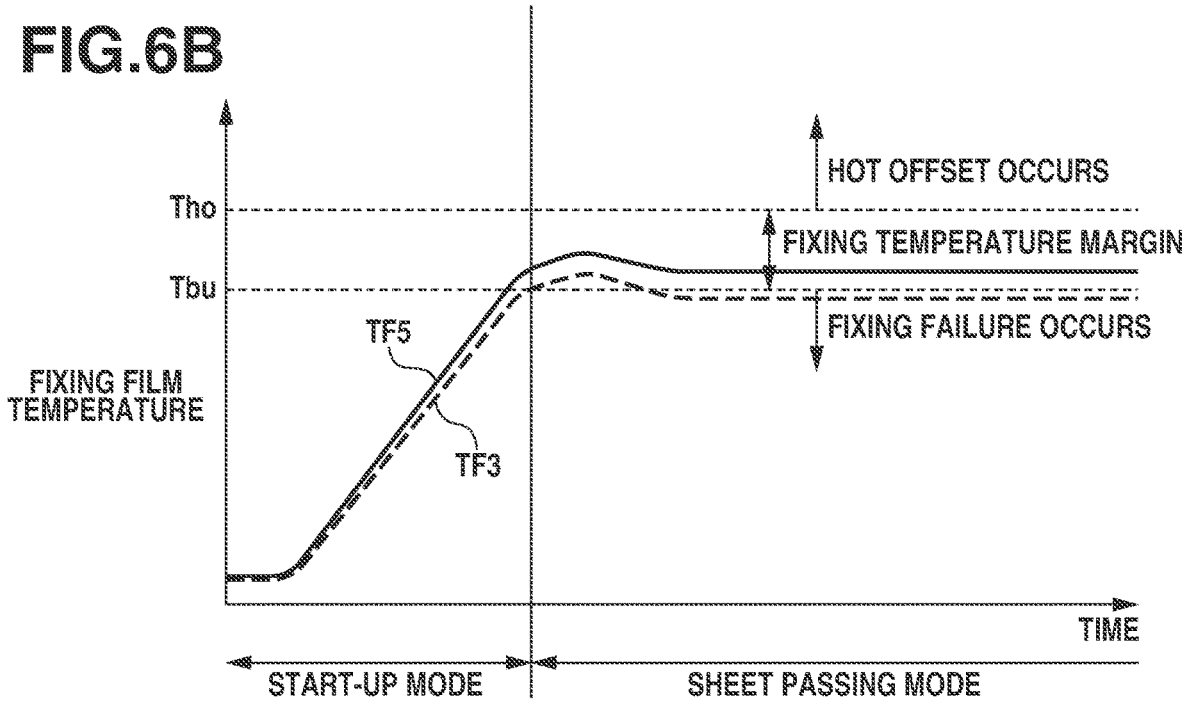

FIGS. 6A and 6B illustrate temperature transition caused in a case where heater control according to the present example embodiment is executed in the drive D2. FIG. 6A illustrates transition of detected temperatures of the main thermistor TM3 (broken line) and the main thermistor TM5 (solid line) of the drive D2. Out of the main thermistor TM3 and the main thermistor TM5, the detected temperature of the main thermistor TM5 is indicated by a thick line as a reference for controlling supplied power to the drive D2, and the control target temperature TGT2 of the drive D2 is indicated by a thick dashed-dotted line. FIG. 6B illustrates temperature transition in the regions TF3 and TF5 of the fixing film 202 that respectively correspond to the heated regions HZ3 and HZ5.

The fixing temperature margin illustrated in FIG. 6B is a temperature range of the fixing film 202 that is set between a lower limit temperature Tbu and an upper limit temperature Tho. In a case where the temperature of the fixing film 202 is set to a temperature lower than or equal to the lower limit temperature Tbu, cold offset occurs. In the cold offset, a toner image includes a defect by partially failing to adhere to the recording material P due to low fixability of toner on the recording material P. In a case where the temperature of the fixing film 202 is set to a temperature higher than or equal to the upper limit temperature Tho, hot offset occurs. In the hot offset, toner on the recording material P adheres to the fixing film 202 by being excessively heated.

In FIG. 6A, a temperature Tunder is a lower limit threshold temperature, and is a temperature set in such a manner that the temperature of the fixing film 202 does not fall below the lower limit temperature Tbu when the recording material P passes through the fixing nip portion N. In other words, the lower limit threshold temperature Tunder is a temperature set in such a manner that cold offset does not occur in heated regions. The temperature Ter is an excessive temperature rise threshold. The upper limit target temperature Tlim is set to a temperature lower than the excessive temperature rise threshold Ter in such a manner that power supply is not blocked due to an excessive temperature rise of a heating block. The upper limit target temperature Tlim is also set in such a manner that the temperature of the fixing film 202 does not exceed the upper limit temperature Tho when the recording material P passes through the fixing nip portion N. In this manner, the present example embodiment aims to execute heater control in such a manner that detected temperatures of the main thermistors TM3 and TM5 fall within the range between the lower limit threshold temperature Tunder and the excessive temperature rise threshold Ter. In the present example embodiment, when heater control is performed in such a manner that both of a detected temperature of a thermistor Tmax and a detected temperature of a thermistor Tmin do not fall below the lower limit threshold temperature Tunder, a temperature Ttgt lower than the upper limit target temperature Tlim and higher than the lower limit threshold temperature Tunder is set as a target temperature. In the present example embodiment, the upper limit target temperature Tlim will also be referred to as a first temperature, the lower limit threshold temperature Tunder will also be referred to as a second temperature, and the target temperature Ttgt will also be referred to as a third temperature. By executing the heater control, it is possible to keep the temperature of the fixing film 202 in the corresponding regions TF3 and TF5 within the range of the fixing temperature margin.

<Case of Executing Temperature Control Using Only Main Thermistor TM5 as Reference Thermistor>

First of all, a case of executing the temperature control using only the main thermistor TM5 as a reference thermistor without considering a variation in resistance value between heating blocks will be described with reference to the temperature transition of the main thermistors illustrated in FIG. 6A. In the start-up mode, the control of rising a detected temperature of the main thermistor TM5 to the upper limit target temperature Tlim is performed. By controlling the detected temperature of the main thermistor TM5 to become the upper limit target temperature Tlim, it is possible to prevent the temperature from exceeding the excessive temperature rise threshold Ter.

After that, the control mode shifts to the sheet passing mode at a timing at which the detected temperature of the main thermistor TM5 reaches the upper limit target temperature Tlim. In the sheet passing mode, the temperature control is executed by switching the control target temperature TGT2 of the drive D2 to the target temperature Ttgt while continuously using the main thermistor TM5 for control.

The temperature transition of the fixing film 202 will be described with reference to FIG. 6B. In the sheet passing mode, by controlling the detected temperature of the main thermistor TM5 using the target temperature Ttgt, the detected temperature of the main thermistor TM3 falls below the lower limit threshold temperature Tunder, and a temperature of the fixing film 202 in the region TF3 falls below the lower limit temperature Tbu.

Thus, if the heater temperature control is executed using only the main thermistor TM5 as a reference thermistor, the temperatures of the fixing film 202 in the regions TF3 and TF5 in the sheet passing mode cannot be brought within the range of the fixing temperature margin.

<Case of Executing Temperature Control Using Only Main Thermistor TM3 as Reference Thermistor>

Figure 7A:
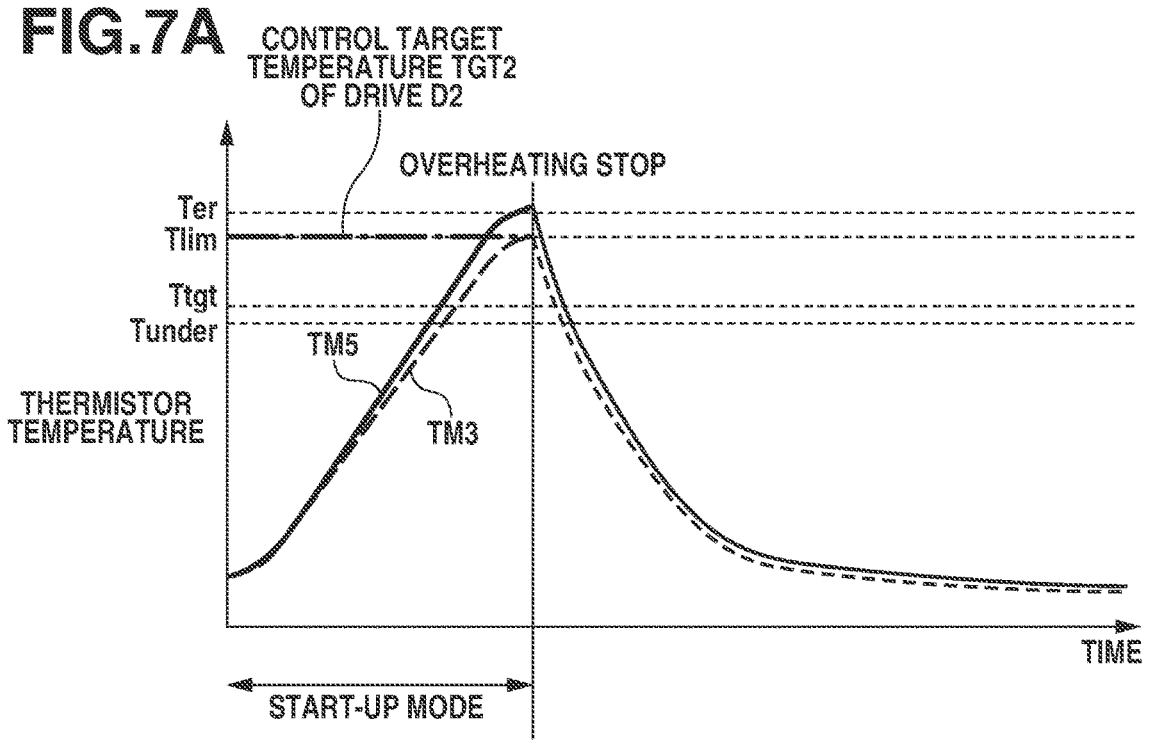
FIGS. 7A and 7B illustrate temperature transition caused in a case where heater control is executed using a reference thermistor as a main thermistor without considering a variation in heat generation amount according to the first example embodiment.

Next, a case of executing the temperature control using only the main thermistor TM3 as a reference thermistor without considering a variation in resistance value between heating blocks will be described with reference to the temperature transition of the main thermistors illustrated in FIG. 7A. In the start-up mode, the control of rising the detected temperature of the main thermistor TM3 to the upper limit target temperature Tlim is performed. At this time, the detected temperature of the main thermistor TM5 exceeds the excessive temperature rise threshold Ter, and power supply to the heater is blocked due to an excessive temperature rise.

Figure 7B:
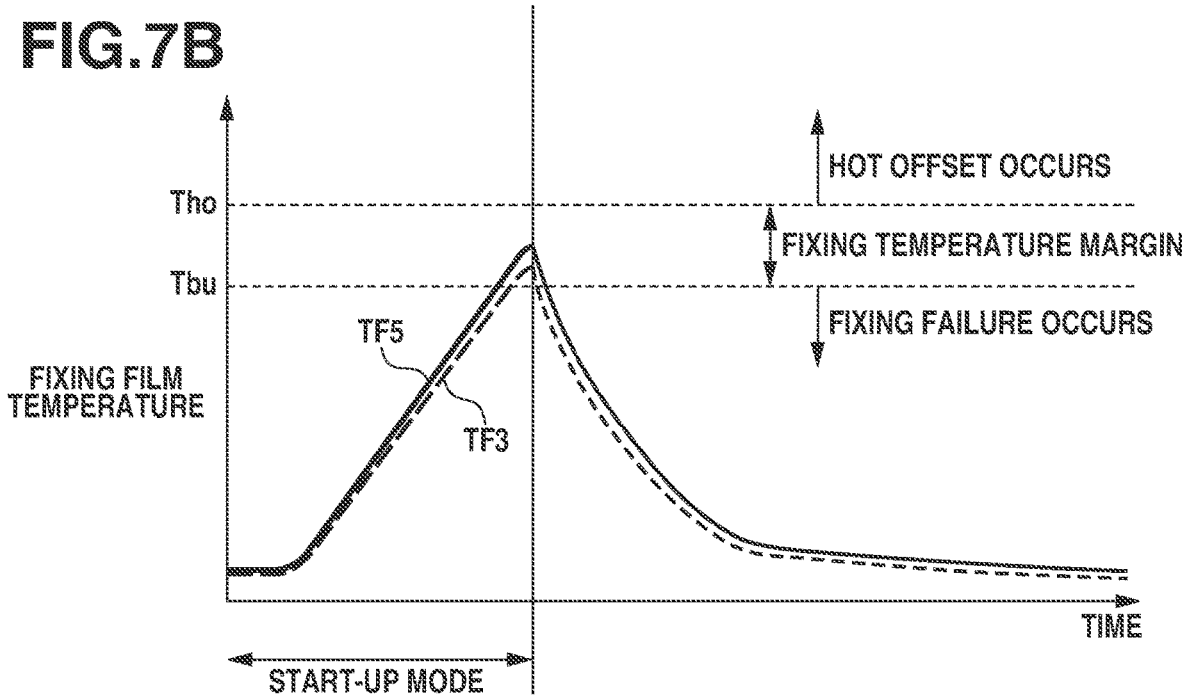

Furthermore, the temperature transition of the fixing film 202 will be described with reference to FIG. 7B. Because power is blocked before the control mode shifts to the sheet passing mode, the temperatures of the heating blocks HB3 and HB5 corresponding to the regions TF3 and TF5 of the fixing film 202 cannot be detected for determining whether the temperatures of the fixing film 202 in the regions TF3 and TF5 fall within the range of the fixing temperature margin.

Thus, if the heater temperature control is executed using only the main thermistor TM3 as a reference thermistor, a heating operation on an image on the recording material P becomes inexecutable.

As described above, if resistance values vary in the drive D2, in a case where the temperature control is executed using only the main thermistor TM5 or the main thermistor TM3 as a reference thermistor, the temperatures of the fixing film 202 in the regions TF3 and TF5 cannot be brought within the range of the fixing temperature margin. In such a case, for bringing a fixing film temperatures in heated regions belonging to the same driving group, into the fixing temperature margin range using the heater control, a variation in heat generation amount between heated regions is to be reduced.

As a method of reducing the above-described influence of a variation in resistance value, a method of selecting a heater with a small variation in heat generation amount in a manufacturing process can be considered. However, this method might involve higher cost in the manufacturing process. Even if a heater with a small variation in heat generation amount is selected, it is difficult to eliminate a variation in heat generation amount. In other words, a structure substituting for or supplementing the method of selecting a heater with a small variation in heat generation amount in a manufacturing process is demanded.

<Heater Control According to Present Example Embodiment>

For this reason, in the present example embodiment, a reference main thermistor of the temperature control is switched by the control unit and the temperature control of the fixing film 202 is changed between the start-up mode and the sheet passing mode. Hereinafter, the heater control according to the present example embodiment will be described with reference to FIGS. 8, 9A, and 9B.

Figure 8:
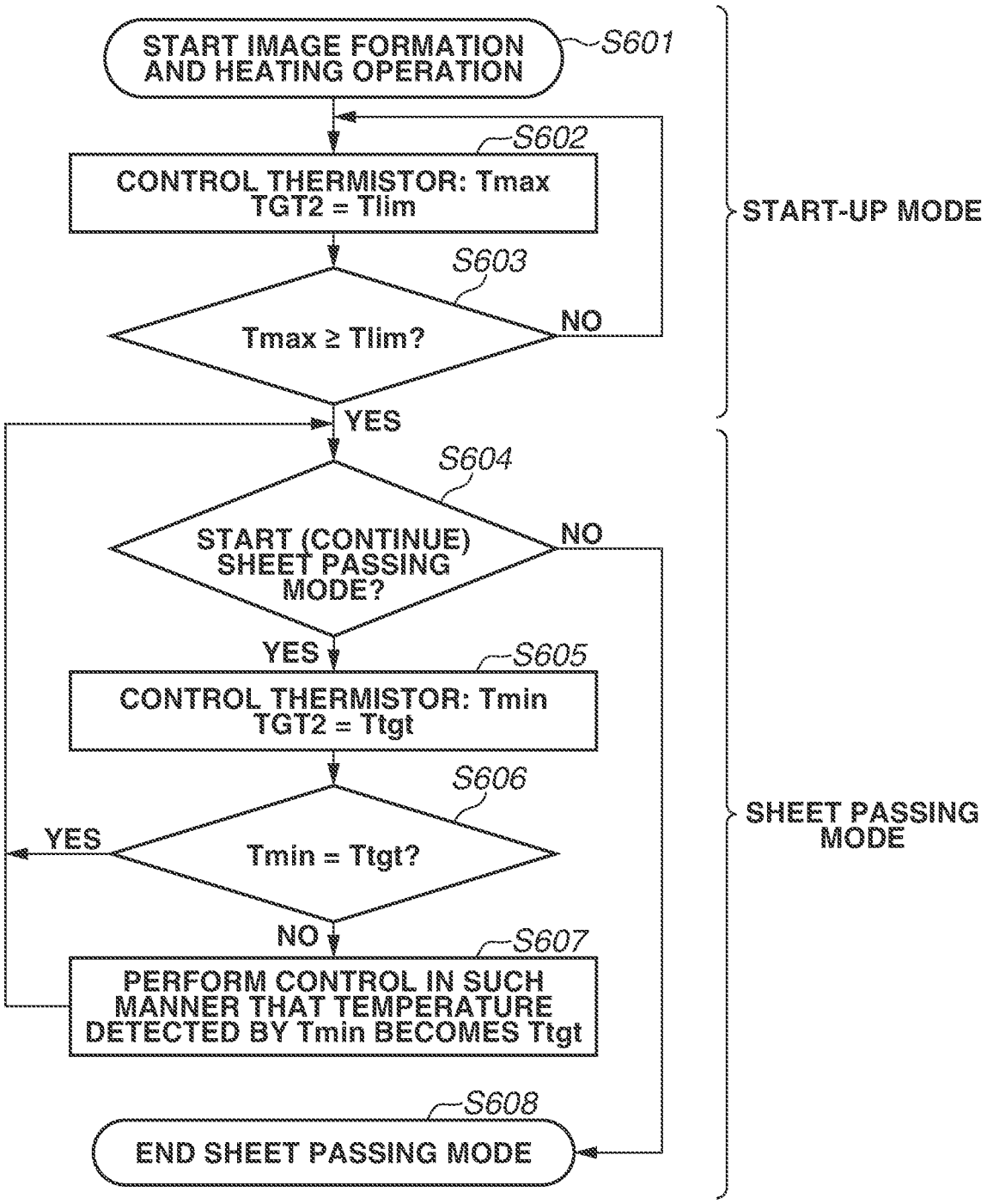
FIG. 8 is a flowchart of processing to be executed by a control unit in heater control according to the first example embodiment.
Figure 9A:
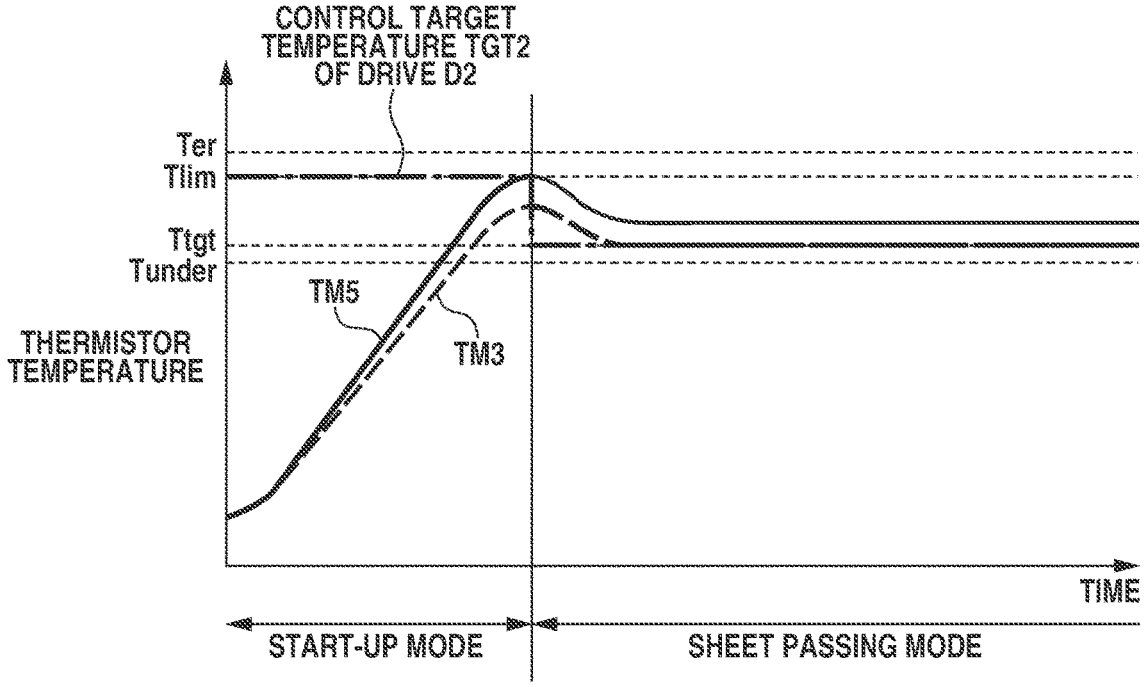
FIGS. 9A and 9B illustrate temperature transition caused in a case where heater control according to the first example embodiment is executed.
Figure 9B:
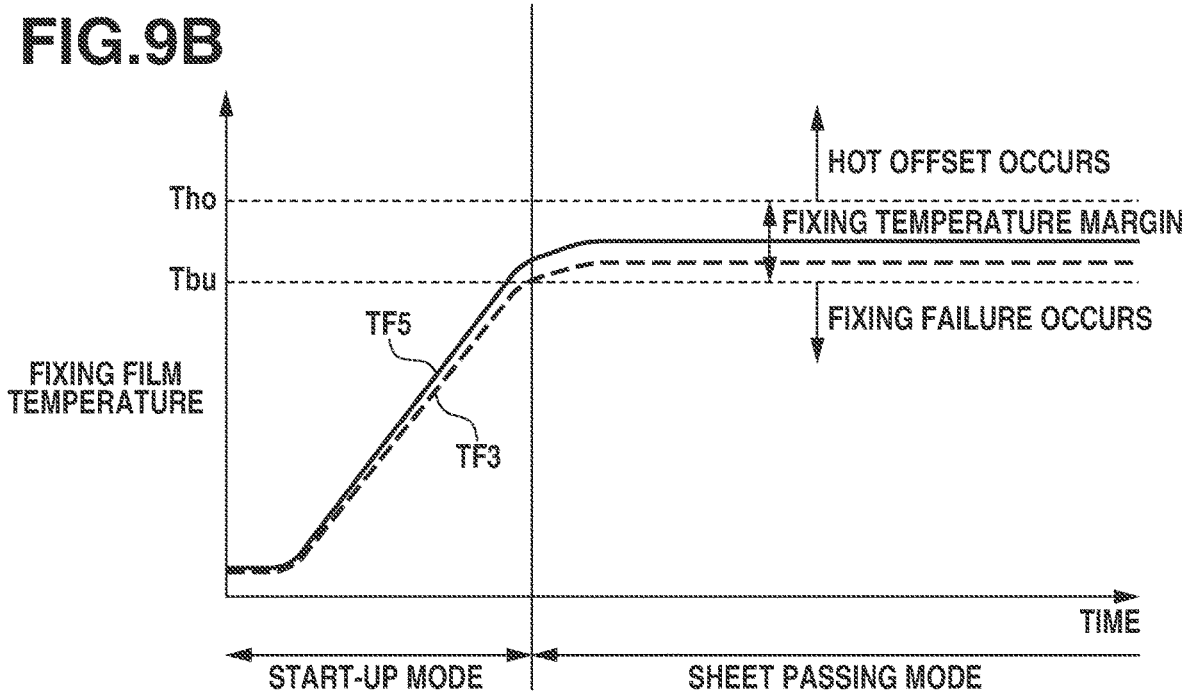

FIG. 8 is a flowchart of processing to be executed by the CPU 420 in the heater control in the same driving group in a case where the recording material P is fixed by the image heating apparatus 200. FIGS. 9A and 9B illustrate temperature transition caused in a case where heater control according to the present example embodiment is executed in the drive D2. FIG. 9A illustrates transition of detected temperatures of the main thermistor TM3 (broken line) and the main thermistor TM5 (solid line) of the drive D2. Out of the main thermistor TM3 and the main thermistor TM5, a detected temperature of a thermistor selected as a temperature control reference for controlling supplied power to the drive D2 is indicated by a thick line, and the control target temperature TGT2 of the drive D2 is indicated by a thick dashed-dotted line.

FIG. 9B illustrates temperature transition in the regions TF3 and TF5 of the fixing film 202 that correspond to the heated regions HZ3 and HZ5.

<Start-Up Mode>

In step S601, the CPU 420 starts an image forming operation by the engine controller 113 controlling each component included in the image forming apparatus 100 in response to a print start command transmitted from the video controller 120 to the engine controller 113. The CPU 420 starts power supply to the image heating apparatus 200 (hereinafter, referred to as a heating operation) in response to the control performed by the engine controller 113. If the CPU 420 starts a heating operation of the image heating apparatus 200, the processing proceeds to step S602.

In step S602, the CPU 420 selects, from among main thermistors arranged in the same driving group, a main thermistor (hereinafter, referred to as a thermistor Tmax) having the highest detected temperature, as a reference thermistor of the temperature control, and controls supplied power to the same driving group. The CPU 420 also sets the control target temperature TGT2 of the thermistor Tmax to the upper limit target temperature Tlim. This is for rising the temperature of the fixing film 202 into the range of the fixing temperature margin as quickly as possible as described above. More specifically, the CPU 420 selects the main thermistor TM5 (solid line), which is the thermistor Tmax, as a reference thermistor of the temperature control as illustrated in FIG. 9A, and controls supplied power to the drive D2 by setting the control target temperature TGT2 of the drive D2 to the upper limit target temperature Tlim. If the CPU 420 selects a reference thermistor of the temperature control and sets the control target temperature TGT2 of the drive D2, the processing proceeds to step S603.

In step S603, the CPU 420 determines whether the detected temperature of the thermistor Tmax is a temperature higher than or equal to the upper limit target temperature Tlim, for executing next processing. In a case where the CPU 420 determines that the detected temperature of the thermistor Tmax is a temperature higher than or equal to the upper limit target temperature Tlim, i.e., in a case where the detected temperature of the main thermistor TM5, which is the thermistor Tmax, has reached the upper limit target temperature Tlim (YES in step S603), the processing proceeds to step S604. In a case where the detected temperature of the thermistor Tmax is a temperature lower than the upper limit target temperature Tlim, i.e., in a case where the detected temperature of the main thermistor TM5, which is the thermistor Tmax, has not reached the upper limit target temperature Tlim (NO in step S603), the processing returns to step S602. By continuing to heat the heater 300 even after the detected temperature of the thermistor Tmax reaches the upper limit target temperature Tlim, the temperature of the fixing film 202 might exceed the fixing temperature margin. Thus, in the present example embodiment, the control mode is shifted from the start-up mode to the sheet passing mode at a timing at which the detected temperature of the thermistor Tmax reaches the upper limit target temperature Tlim.

In the present example embodiment, the shift timing is set to a timing at which the detected temperature of the thermistor Tmax reaches the upper limit target temperature Tlim, but the shift timing is not limited to this timing. For example, the control mode may be shifted from the start-up mode to the sheet passing mode at a timing at which the recording material P reaches the fixing nip portion N. The control mode is shifted at this timing considering that the heat of the heating blocks HB is drawn by the recording material P by the recording material P passing through the heated regions (HZ1 to HZ7) in the sheet passing mode. In this case, until the recording material P reaches the fixing nip portion N, control is performed using the upper limit target temperature Tlim as a control target temperature of the thermistor Tmax, and detected temperatures of the main thermistors TM in the same driving group are controlled not to exceed the upper limit target temperature Tlim.

<Sheet Passing Mode>

In step S604, the CPU 420 determines whether to start or continue the sheet passing mode. In a case where the sheet passing mode is to be started or continued (YES in step S604), the processing proceeds to step S605. In a case where the sheet passing mode is to be ended (NO in step S604), the processing proceeds to step S608.

In step S605, the CPU 420 selects, from among main thermistors arranged in the same driving group, a main thermistor (hereinafter, referred to as a thermistor Tmin) having the lowest detected temperature, as a reference thermistor of the temperature control, and controls supplied power to the same driving group. The CPU 420 also sets the control target temperature TGT2 of the drive D2 to the target temperature Ttgt using the thermistor Tmin as a reference thermistor of the temperature control. By setting a temperature higher than the lower limit threshold temperature Tunder as the target temperature Ttgt, detected temperatures of the main thermistors TM are controlled not to fall below the lower limit threshold temperature Tunder. More specifically, the CPU 420 selects the main thermistor TM3 (broken line), which is the thermistor Tmin, as a reference thermistor of the temperature control as illustrated in FIG. 9A, and controls supplied power to the drive D2 by setting the control target temperature TGT2 of the drive D2 to the target temperature Ttgt. When the CPU 420 selects a reference thermistor of the temperature control and sets the control target temperature TGT2 of the drive D2, the processing proceeds to step S606.

In step S606, the CPU 420 monitors detected temperatures of the main thermistors arranged in the same driving group, and determines whether the detected temperature of the thermistor Tmin is a temperature equal to the target temperature Ttgt, for executing next processing. In a case where the CPU 420 determines that the detected temperature of the thermistor Tmin is a temperature equal to the target temperature Ttgt. In a case where the detected temperature of the main thermistor TM3, which is the thermistor Tmin, is a temperature equal to the target temperature Ttgt (YES in step S606), the processing returns to step S604, and the CPU 420 executes next processing based on whether to continue the sheet passing mode. In a case where the detected temperature of the thermistor Tmin is not a temperature equal to the target temperature Ttgt, i.e., in a case where the detected temperature of the main thermistor TM3, which is the thermistor Tmin, is not a temperature equal to the target temperature Ttgt (NO in step S606), the processing proceeds to step S607.

In step S607, the CPU 420 controls the detected temperature of the thermistor Tmin to become the target temperature Ttgt. As an example of the processing performed at this time, in a case where the detected temperature of the thermistor Tmin is higher than the target temperature Ttgt, a power supply amount is decreased based on a difference between the detected temperature of the thermistor Tmin and the target temperature Ttgt. In a case where the detected temperature of the thermistor Tmin is lower than the target temperature Ttgt, a power supply amount is increased based on a difference between the detected temperature of the thermistor Tmin and the target temperature Ttgt. If the CPU 420 ends the control of a power supply amount, the processing returns to step S604, and the CPU 420 executes next processing based on whether to continue the sheet passing mode.

In step S608, the CPU 420 ends the sheet passing mode. The description of subsequent processing will be omitted.

As described above, in the present example embodiment, as a reference thermistor of the temperature control, the thermistor Tmax is used by the control unit in the start-up mode, and the thermistor Tmin is used by the control unit in the sheet passing mode. In the present example embodiment, the CPU 420 selects the thermistor Tmax and the thermistor Tmin based on detected temperatures of main thermistors. By executing heater control in this manner, as illustrated in FIG. 9B, temperatures of the fixing film 202 in the regions TF3 and TF5 in the sheet passing mode can be brought into the range of the fixing temperature margin.

Modified Example 1 of First Example Embodiment

In the first example embodiment, when selecting reference thermistors of the temperature control in the start-up mode and the sheet passing mode, the CPU 420 selects the thermistor Tmax and the thermistor Tmin as reference thermistors of the temperature control based on detected temperatures of main thermistors. However, in the present example embodiment, the selection method is not limited to this method. The CPU 420 may include a storage unit, and the thermistor Tmax and the thermistor Tmin preliminarily detected in a manufacturing process may be stored in the storage unit. By the method, in the present example embodiment, in the start-up mode, the thermistor Tmax stored in the storage unit is used as a reference thermistor of the temperature control, and the control target temperature TGT2 of the drive D2 is set to the upper limit target temperature Tlim. In the sheet passing mode, the thermistor Tmin stored in the storage unit is used as a reference thermistor of the temperature control, and the control target temperature TGT2 of the drive D2 is set to the target temperature Ttgt.

When the thermistor Tmax and the thermistor Tmin are preliminarily detected in the manufacturing process, heat generation amounts of the heating blocks (HB1 to HB7) may be measured. In this case, a main thermistor that detects a temperature of a heating block having the largest heat generation amount in the same driving group is stored into the storage unit as the thermistor Tmax, and a main thermistor that detects a temperature of a heating block having the smallest heat generation amount in the same driving group is stored into the storage unit as the thermistor Tmin.

When the thermistor Tmax and the thermistor Tmin are preliminarily detected in the manufacturing process, resistance values of the heating blocks (HB1 to HB7) may be measured. In this case, a main thermistor that detects a temperature of a heating block having the smallest resistance value in the same driving group is stored into the storage unit as the thermistor Tmax, and a main thermistor that detects a temperature of a heating block having the largest resistance value in the same driving group is stored into the storage unit as the thermistor Tmin.

Modified Example 2 of First Example Embodiment

In the first example embodiment and Modified Example 1 of the first example embodiment, the description has been given of a method of selecting the thermistor Tmax as a reference thermistor of the temperature control in the start-up mode. However, in the case of monitoring temperatures of all the main thermistors TM in the same driving group, the selection method is not limited to this method.

In the start-up mode, heat generation amounts of all heating blocks HB in the same driving group need to be larger than or equal to the lower limit threshold temperature Tunder, and at this time, the heat generation amounts of the heating blocks HB need to be controlled not to exceed the excessive temperature rise threshold Ter. Thus, first of all, the CPU 420 includes a storage unit, stores the thermistor Tmax and the thermistor Tmin preliminarily detected in a manufacturing process, into the storage unit, and also detects a difference ΔT between the detected temperature of the thermistor Tmax and the detected temperature of the thermistor Tmin. Then, the CPU 420 monitors a detected temperature of a main thermistor of the heating block HB that serves as the thermistor Tmax. With this configuration, in a case where the difference ΔT between the detected temperature of the thermistor Tmax and the detected temperature of the thermistor Tmin is smaller than a difference between the temperatures Tlim and Ttgt, whichever main thermistor is selected as a reference thermistor of the temperature control, when the detected temperature of the thermistor Tmax reaches the upper limit target temperature Tlim, detected temperatures of all main thermistors in the same driving group exceed the target temperature Ttgt. The difference ΔT is a difference between the detected temperature of the thermistor Tmax and the detected temperature of the thermistor Tmin that is obtained when the detected temperature of the thermistor Tmax reaches the upper limit target temperature Tlim, and the difference ΔT remains constant throughout the sheet passing mode.

For this reason, in the present modified example, in the start-up mode, the thermistor Tmax needs not be always used as a reference thermistor of the temperature control. However, in the sheet passing mode, in consideration of the prevention of cold offset, using the thermistor Tmin as the reference thermistor of the temperature control, heat generation amounts of all the heating blocks HB in the same driving group are controlled to be larger than or equal to the target temperature Ttgt. The present modified example is similar to the first example embodiment and Modified Example 1 of the first example embodiment in that the reference thermistor of the temperature control and the control target temperature are changed between the start-up mode and the sheet passing mode.

In the first example embodiment and Modified Example 1 of the first example embodiment, the case of executing heater control of the drive D2 as the same driving group has been described as an example. In the present modified example, a case where a heat generation amount varies between heated regions of the drive D1 will be described. For example, a case where a heat generation amount of the heating block HB1 is the largest, and a heat generation amount of the heating block HB7 is the smallest will be described.

<Heater Control According to Present Modified Example>

Hereinafter, heater control according to the present modified example will be described with reference to FIGS. 10, 11A, and 11B.

Figure 10:
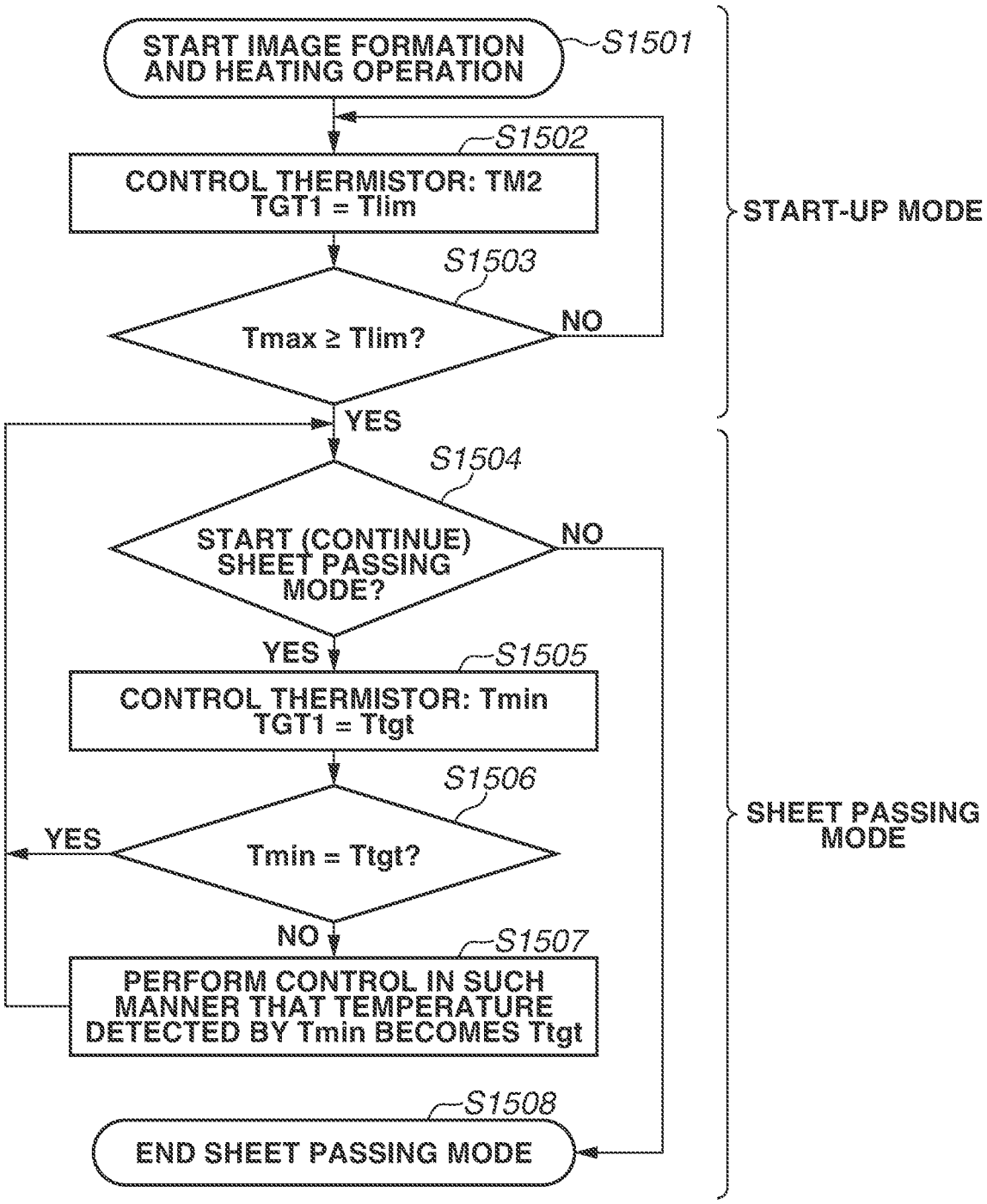
FIG. 10 is a flowchart of processing to be executed by a control unit in heater control according to a modified example of the first example embodiment.

FIG. 10 is a flowchart of processing to be executed by the CPU 420 in heater control in the same driving group in a case where the recording material P is fixed by the image heating apparatus 200. FIGS. 11A and 11B illustrate temperature transition caused in a case where heater control according to the present modified example is executed in the drive D1. FIG. 11A illustrates transition of detected temperatures of the main thermistor TM7 (thin broken line), the main thermistor TM2 (broken line), and the main thermistor TM1 (solid line) of the drive D1. Out of the main thermistors TM7, TM2, and TM1, a detected temperature of a thermistor selected as a temperature control reference for controlling supplied power to the drive D1 is indicated by a thick line, and the control target temperature TGT1 of the drive D1 is indicated by a thick dashed-dotted line. FIG. 11B illustrates temperature transition in the regions TF7, TF2, and TF1 of the fixing film 202 that correspond to the heated regions HZ7, HZ2, and HZ1.

<Start-Up Mode>

In step S1501, the CPU 420 starts an image forming operation by the engine controller 113 controlling each component included in the image forming apparatus 100 in response to a print start command transmitted from the video controller 120 to the engine controller 113. The CPU 420 starts power supply to the image heating apparatus 200 (hereinafter, referred to as a heating operation) based on the control performed by the engine controller 113. If the CPU 420 starts a heating operation of the image heating apparatus 200, the processing proceeds to step S1502.

In step S1502, the CPU 420 selects the main thermistor TM2 as a reference thermistor of the temperature control from among main thermistors arranged in the same driving group, and controls supplied power to the same driving group. The CPU 420 also sets the control target temperature TGT1 of the drive D1 to the upper limit target temperature Tlim. This is for rising the temperature of the fixing film 202 into the range of the fixing temperature margin as quickly as possible as described above.

Figure 11A:
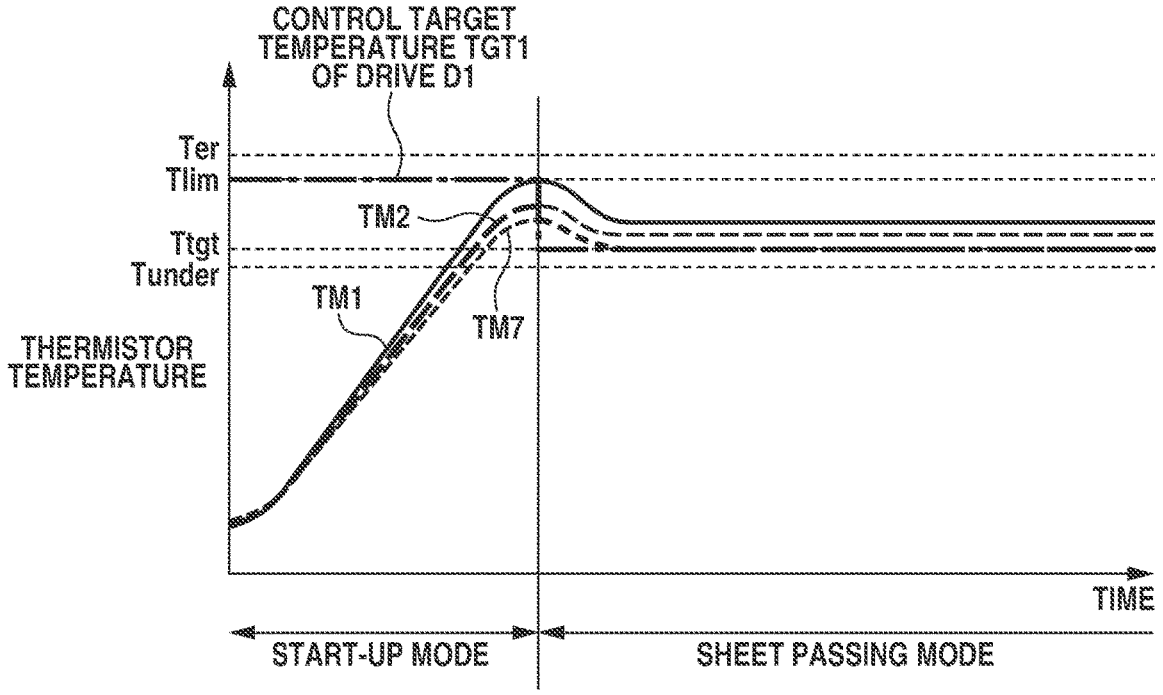
FIGS. 11A and 11B illustrate temperature transition caused in a case where heater control according to a modified example of the first example embodiment is executed.
Figure 11B:
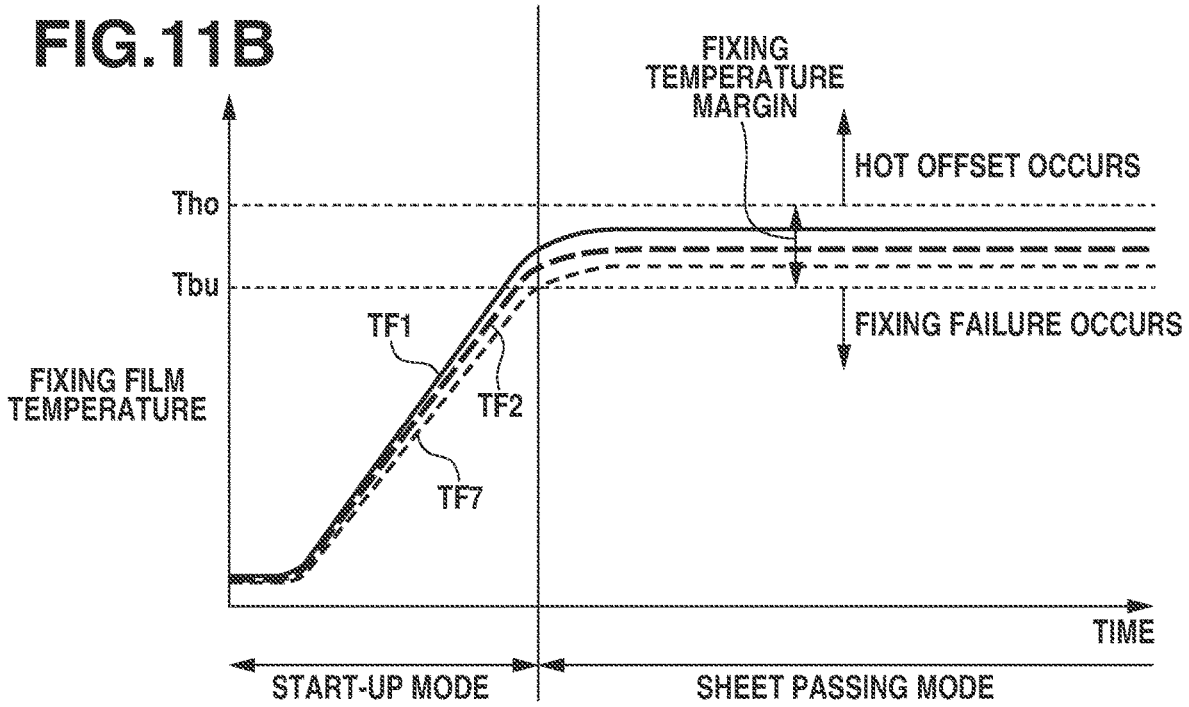

More specifically, the CPU 420 selects the main thermistor TM2 (broken line) as a reference thermistor of the temperature control as illustrated in FIG. 11A, and controls supplied power to the drive D1 by setting the control target temperature TGT1 of the drive D1 to the upper limit target temperature Tlim. If the CPU 420 selects a reference thermistor of the temperature control and sets the control target temperature TGT1 of the drive D1, the processing proceeds to step S1503. The reference thermistor of the temperature control that is selected at this time may be any of the main thermistors TM7, TM2, and TM1.

In step S1503, the CPU 420 determines whether the detected temperature of the thermistor Tmax is a temperature higher than or equal to the upper limit target temperature Tlim, for executing next processing. In a case where the CPU 420 determines that the detected temperature of the thermistor Tmax is a temperature higher than or equal to the upper limit target temperature Tlim, i.e., in a case where the detected temperature of the main thermistor TM1, which is the thermistor Tmax, has reached the upper limit target temperature Tlim (YES in step S1503), the processing proceeds to step S1504. In a case where the detected temperature of the thermistor Tmax is a temperature lower than the upper limit target temperature Tlim, i.e., in a case where the detected temperature of the main thermistor TM1, which is the thermistor Tmax, has not reached the upper limit target temperature Tlim (NO in step S1503), the processing returns to step S1502. At this time, the detected temperature of the main thermistor TM2 selected as a reference thermistor of the temperature control has not reached the upper limit target temperature Tlim in some cases. However, because a difference between the detected temperature of the main thermistor TM1, which is the thermistor Tmax and the detected temperature of the main thermistor TM7, which is the thermistor Tmin, is smaller than a difference between the temperatures Tlim and Ttgt, if the detected temperature of the main thermistor TM1, which is the thermistor Tmax, reaches the upper limit target temperature Tlim, the detected temperature of the main thermistor TM7, which is the thermistor Tmin, exceeds the target temperature Ttgt. By continuing to heat the heater 300 even after the detected temperature of the thermistor Tmax reaches the upper limit target temperature Tlim, the temperature of the fixing film 202 may exceed the fixing temperature margin.

Thus, in the present modified example, the control mode is shifted from the start-up mode to the sheet passing mode at a timing at which the detected temperature of the thermistor Tmax reaches the upper limit target temperature Tlim.

In the present modified example, the shift timing is set to the timing at which the detected temperature of the thermistor Tmax reaches the upper limit target temperature Tlim, but the shift timing is not limited to this timing. For example, the control mode may be shifted from the start-up mode to the sheet passing mode at a timing at which the recording material P reaches the fixing nip portion N. The control mode is shifted at this timing considering that the heat of the heating blocks HB is taken by the recording material P by the recording material P passing through the heated regions (HZ1 to HZ7) in the sheet passing mode. In this case, until the recording material P reaches the fixing nip portion N, control is performed using the upper limit target temperature Tlim as a control target temperature of the thermistor Tmax, and detected temperatures of the main thermistors TM in the same driving group are controlled not to exceed the upper limit target temperature Tlim.

<Sheet Passing Mode>

In step S1504, the CPU 420 determines whether to start or continue the sheet passing mode. In a case where the sheet passing mode is to be started or continued (YES in step S1504), the processing proceeds to step S1505. In a case where the sheet passing mode is to be ended (NO in step S1504), the processing proceeds to step S1508.

In step S1505, the CPU 420 selects, from among main thermistors arranged in the same driving group, a main thermistor (hereinafter, referred to as a thermistor Tmin) having the lowest detected temperature, as a reference thermistor of the temperature control, and controls supplied power to the same driving group. The CPU 420 also sets the control target temperature TGT1 of the drive D1 to the target temperature Ttgt using the thermistor Tmin as a reference thermistor of the temperature control. The target temperature Ttgt is a temperature set in such a manner that the temperature of the fixing film 202 does not fall below the lower limit temperature Tbu of the fixing temperature margin as described above. More specifically, the CPU 420 selects the main thermistor TM7 (thin broken line), which is the thermistor Tmin, as a reference thermistor of the temperature control as illustrated in FIG. 11A, and controls supplied power to the drive D1 by setting the control target temperature TGT1 of the drive D1 to the target temperature Ttgt. If the CPU 420 selects a reference thermistor of the temperature control and sets the control target temperature TGT1 of the drive D1, the processing proceeds to step S1506.

In step S1506, the CPU 420 monitors detected temperatures of the main thermistors arranged in the same driving group, and determines whether the detected temperature of the thermistor Tmin is a temperature equal to the target temperature Ttgt, for executing next processing. In a case where the CPU 420 determines that the detected temperature of the thermistor Tmin is a temperature equal to the target temperature Ttgt, i.e., in a case where the detected temperature of the main thermistor TM7, which is the thermistor Tmin, is a temperature equal to the target temperature Ttgt (YES in step S1506), the processing returns to step S1504, and the CPU 420 executes next processing based on whether to continue the sheet passing mode.

In a case where the detected temperature of the thermistor Tmin is not a temperature equal to the target temperature Ttgt, i.e., in a case where the detected temperature of the main thermistor TM7, which is the thermistor Tmin, is not a temperature equal to the target temperature Ttgt (NO in step S1506), the processing proceeds to step S1507.

In step S1507, the CPU 420 controls the detected temperature of the thermistor Tmin to become the target temperature Ttgt. As an example of the processing performed at this time, in a case where the detected temperature of the thermistor Tmin is higher than the target temperature Ttgt, a power supply amount is decreased based on a difference between the detected temperature of the thermistor Tmin and the target temperature Ttgt. In a case where the detected temperature of the thermistor Tmin is lower than the target temperature Ttgt, a power supply amount is increased based on a difference between the detected temperature of the thermistor Tmin and the target temperature Ttgt. If the CPU 420 ends the control of the power supply amount, the processing returns to step S1504, and the CPU 420 executes next processing based on whether to continue the sheet passing mode.

In step S1508, the CPU 420 ends the sheet passing mode. The description of subsequent processing will be omitted.

As described above, in the present modified example, the following heater control method is used as a structure substituting for or supplementing a method of selecting two or more heating blocks with a small variation in heat generation amount in a manufacturing process. More specifically, the reference main thermistor of the temperature control is switched by the control unit and the temperature control of the fixing film 202 is varied between the start-up mode and the sheet passing mode. By this method, it becomes possible to bring film temperatures in heated regions belonging to the same driving group, within the fixing temperature margin range while suppressing an increase in manufacturing cost and a decline in accuracy.

In the first example embodiment, a method of switching the reference main thermistor of the temperature control between the start-up mode and the sheet passing mode by the control unit has been described as a heater control method. A second example embodiment is different from the first example embodiment in that, as indicated by a thick solid line in FIG. 13A, the thermistor Tmax is used as a reference thermistor of the temperature control throughout the start-up mode and the sheet passing mode, and the control target temperature TGT2 of the drive D2 is set based on a difference ΔT between the detected temperature of the thermistor Tmax and the detected temperature of the thermistor Tmin. In the present example embodiment, the thermistor Tmax is used as a reference thermistor of the temperature control also in the sheet passing mode. Thus, in a manufacturing process, a difference ΔT between the detected temperature of the thermistor Tmax and the detected temperature of the thermistor Tmin is preliminarily measured in such a manner that the detected temperature of the thermistor Tmin does not fall below the lower limit threshold temperature Tunder in the sheet passing mode. Then, using the thermistor Tmax as a reference thermistor of the temperature control, the control target temperature TGT2 of the drive D2 is set to the target temperature Ttgt+the difference ΔT. At this time, in consideration of the prevention of cold offset, using the thermistor Tmax as a reference thermistor of the temperature control, the control target temperature TGT2 of the drive D2 may be set to a temperature higher than the target temperature Ttgt+the difference ΔT.

In a case where a sheet non-passing portion temperature rise occurs in a heating block in which the thermistor Tmax is arranged, a value of the difference ΔT between the detected temperature of the thermistor Tmax and the detected temperature of the thermistor Tmin becomes different from the value of the difference ΔT that has been preliminarily measured in the manufacturing process. If heater control according to the present example embodiment is executed in this case as well, the detected temperature of the thermistor Tmin sometimes falls below the target temperature Ttgt. Thus, in the present example embodiment, in consideration of the prevention of cold offset, heater control according to the present example embodiment is executed only in a case where a sheet non-passing portion temperature rise does not occur in the thermistor Tmax. For example, after image formation is executed onto a small-sized sheet that can cause a sheet non-passing portion temperature rise, heater control according to the present example embodiment is not executed.

Hereinafter, heater control according to the present example embodiment will be described with reference to FIGS. 12, 13A, and 13B. In the following description, the same configurations as those in the first example embodiment are assigned the same numbers, and the description thereof will be omitted.

Figure 12:
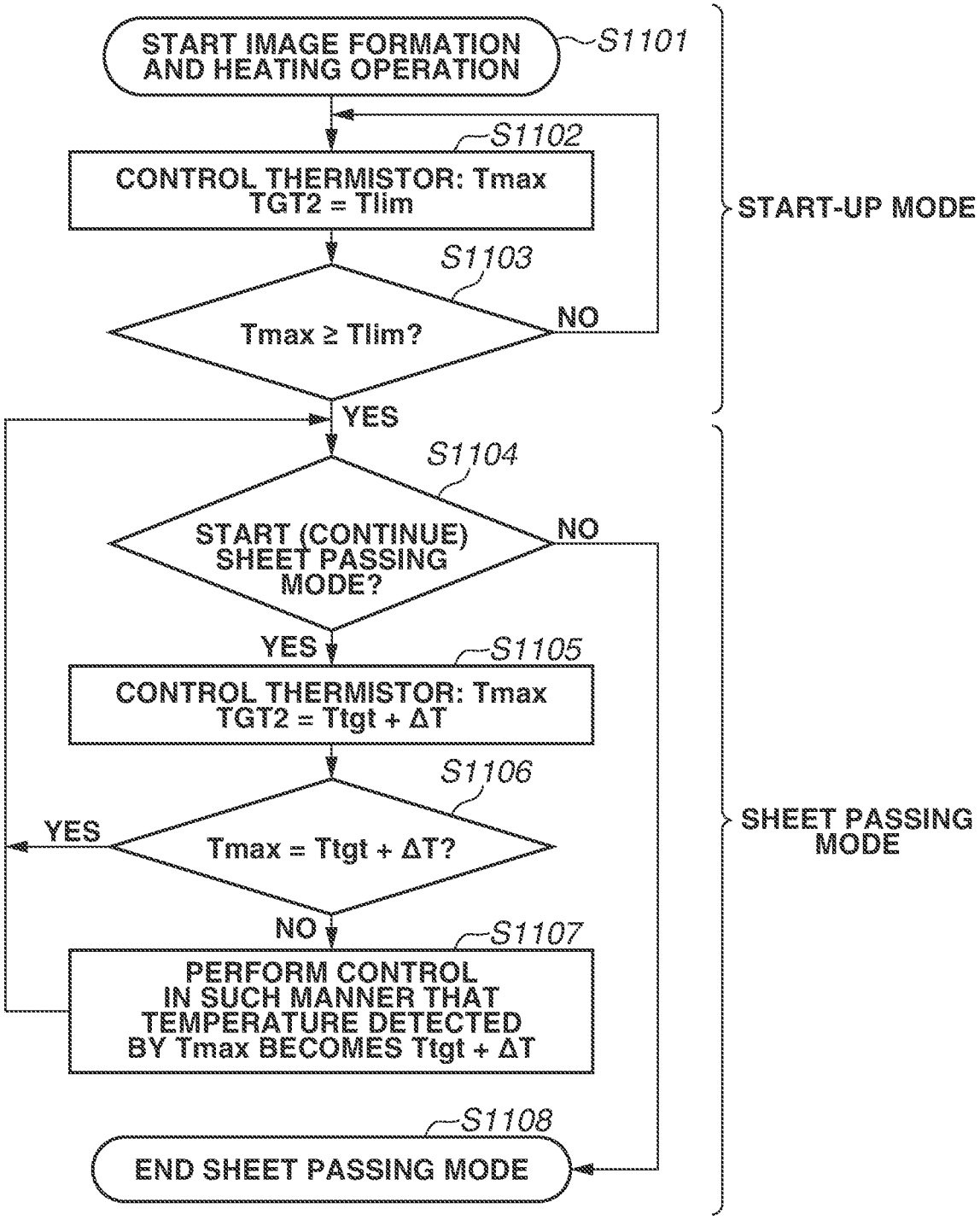
FIG. 12 is a flowchart of processing to be executed by a control unit in heater control according to a second example embodiment.
Figure 13A:
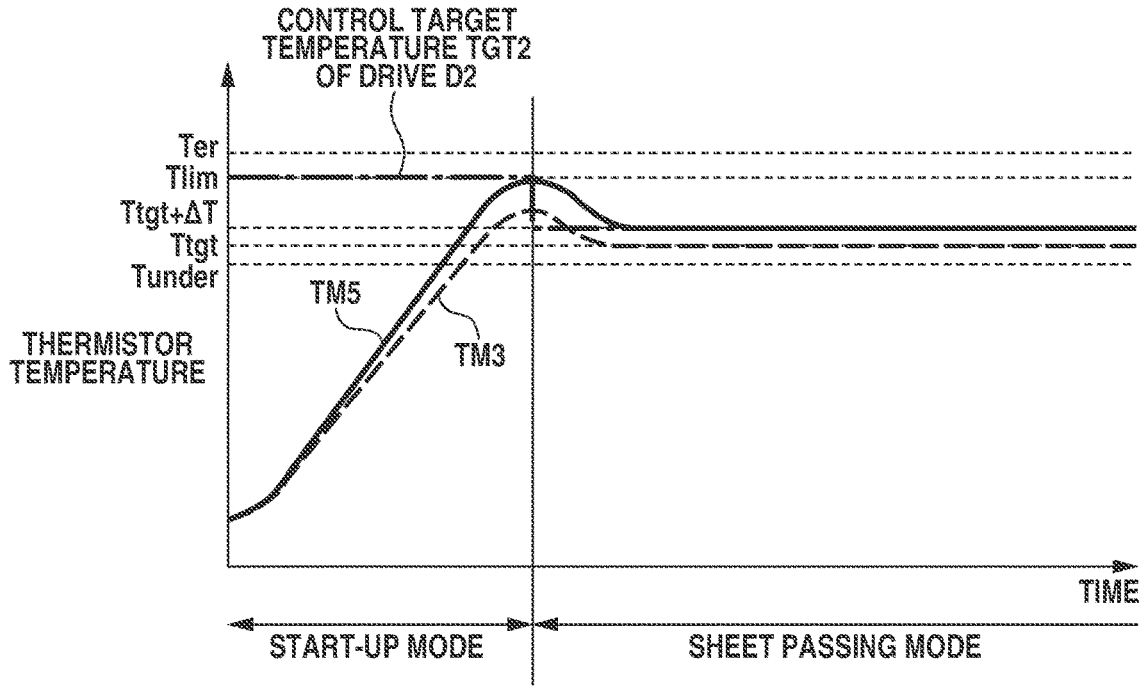
FIGS. 13A and 13B illustrate temperature transition caused in a case where heater control according to the second example embodiment is executed.
Figure 13B:
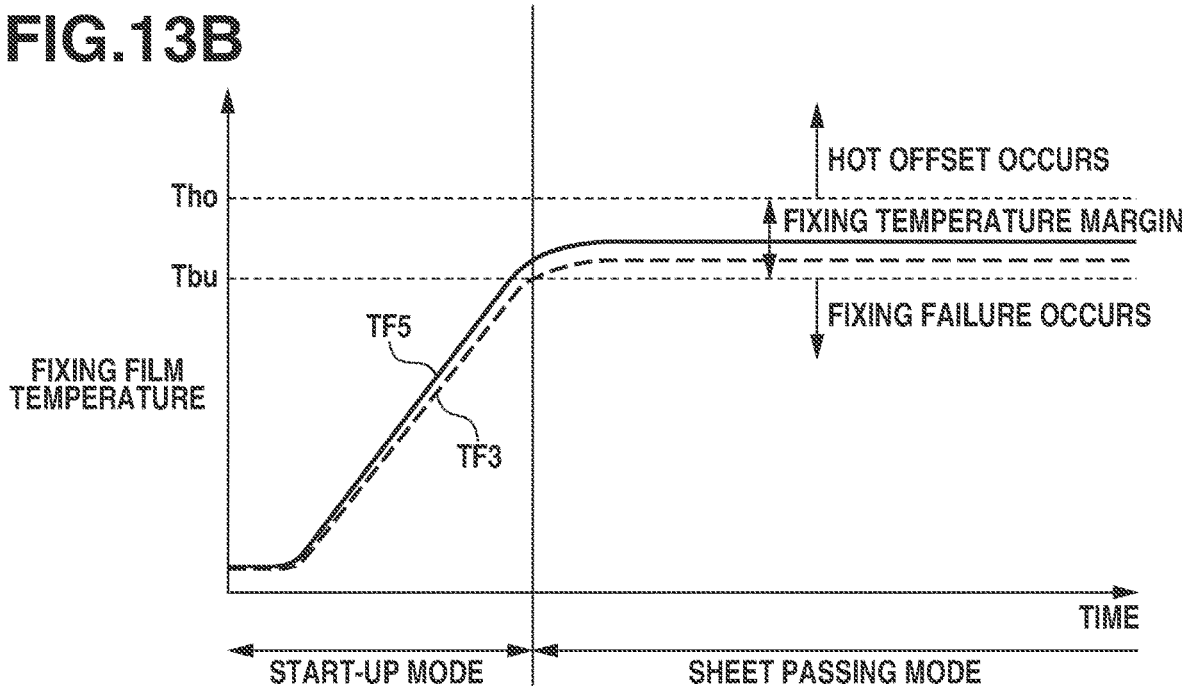

FIG. 12 is a flowchart of processing to be executed by the CPU 420 in heater control in the same driving group according to the present example embodiment. FIGS. 13A and 13B illustrate temperature transition caused in a case where heater control according to the present example embodiment is executed in the drive D2. FIG. 13A illustrates transition of detected temperatures of the main thermistor TM3 (broken line) and the main thermistor TM5 (solid line) of the drive D2. Out of the main thermistor TM3 and the main thermistor TM5, the detected temperature of a thermistor selected as a temperature control reference for controlling supplied power to the drive D2 is indicated by a thick line, and the control target temperature TGT2 of the drive D2 is indicated by a thick dashed-dotted line. FIG. 13B illustrates temperature transition in the regions TF3 and TF5 of the fixing film 202 that correspond to the heated regions HZ3 and HZ5.

<Start-Up Mode>

In step S1101, the CPU 420 starts an image forming operation by the engine controller 113 controlling each component included in the image forming apparatus 100 in response to a print start command transmitted from the video controller 120 to the engine controller 113. The CPU 420 starts a heating operation of the image heating apparatus 200 based on the control performed by the engine controller 113. If the CPU 420 starts a heating operation of the image heating apparatus 200, the processing proceeds to step S1102.

In step S1102, the CPU 420 selects, from among main thermistors arranged in the same driving group, a main thermistor Tmax having the highest detected temperature that has been preliminarily detected in a manufacturing process, as a reference thermistor of the temperature control, and controls supplied power to the same driving group. At this time, the CPU 420 may detect a main thermistor Tmax having the highest detected temperature among main thermistors arranged in the same driving group, and select the main thermistor Tmax as a reference thermistor of the temperature control. Using the thermistor Tmax as a reference thermistor of the temperature control, the CPU 420 sets the control target temperature TGT2 of the drive D2 to the upper limit target temperature Tlim. More specifically, the CPU 420 selects the main thermistor TM5 (solid line), which is the thermistor Tmax, as a reference thermistor of the temperature control as illustrated in FIG. 13A, and controls supplied power to the drive D2 by setting the control target temperature TGT2 of the drive D2 to the upper limit target temperature Tlim. If the CPU 420 selects a reference thermistor of the temperature control and sets the control target temperature TGT2 of the drive D2, the processing proceeds to step S1103.

In step S1103, the CPU 420 determines whether a detected temperature of the thermistor Tmax is a temperature higher than or equal to the upper limit target temperature Tlim, for executing next processing. In a case where the CPU 420 determines that the detected temperature of the thermistor Tmax is a temperature higher than or equal to the upper limit target temperature Tlim, i.e., in a case where the detected temperature of the main thermistor TM5, which is the thermistor Tmax, has reached the upper limit target temperature Tlim (YES in step S1103), the processing proceeds to step S1104. In a case where the detected temperature of the thermistor Tmax is a temperature lower than the upper limit target temperature Tlim, i.e., in a case where the detected temperature of the main thermistor TM5, which is the thermistor Tmax, has not reached the upper limit target temperature Tlim (NO in step S1103), the processing returns to step S1102.

<Sheet Passing Mode>

In step S1104, the CPU 420 determines whether to start or continue the sheet passing mode. In a case where the sheet passing mode is to be started or continued, (YES in step S1104), the processing proceeds to step S1105. In a case where the sheet passing mode is to be ended (NO in step S1104), the processing proceeds to step S1108.

In step S1105, continuously using the thermistor Tmax as a reference thermistor of the temperature control, the CPU 420 controls supplied power to the same driving group. At this time, as described above, using the thermistor Tmax as a reference thermistor of the temperature control, the CPU 420 sets the control target temperature TGT2 of the drive D2 to the target temperature Ttgt+the difference ΔT. More specifically, the CPU 420 selects the main thermistor TM5 (solid line), which is the thermistor Tmax, as a reference thermistor of the temperature control as illustrated in FIG. 13A, and controls supplied power to the drive D2 by setting the control target temperature TGT2 of the drive D2 to the target temperature Ttgt+the difference ΔT. When the CPU 420 sets the control target temperature TGT2 of the drive D2, the processing proceeds to step S1106.

In step S1106, the CPU 420 monitors detected temperatures of the main thermistors arranged in the same driving group, and determines whether the detected temperature of the thermistor Tmax is a temperature equal to the target temperature Ttgt+the difference ΔT, for executing next processing. In a case where the CPU 420 determines that the detected temperature of the thermistor Tmax is a temperature equal to the target temperature Ttgt+the difference ΔT, i.e., in a case where the detected temperature of the main thermistor TM5, which is the thermistor Tmax, is a temperature equal to the target temperature Ttgt+the difference ΔT (YES in step S1106), the processing returns to step S1104, and the CPU 420 executes next processing based on whether to continue the sheet passing mode. In a case where the detected temperature of the thermistor Tmax is not a temperature equal to the target temperature Ttgt+the difference ΔT, i.e., in a case where the detected temperature of the main thermistor TM5, which is the thermistor Tmax, is not a temperature equal to the target temperature Ttgt+the difference ΔT (NO in step S1106), the processing proceeds to step S1107.

In step S1107, the CPU 420 controls the detected temperature of the thermistor Tmax to become the target temperature Ttgt+the difference ΔT. As an example of the processing performed at this time, in a case where the detected temperature of the thermistor Tmax is higher than the target temperature Ttgt+the difference ΔT, a power supply amount is decreased based on a difference between the detected temperature of the thermistor Tmax and the target temperature Ttgt+the difference ΔT. In a case where the detected temperature of the thermistor Tmax is lower than the target temperature Ttgt+the difference ΔT, a power supply amount is increased based on a difference between the detected temperature of the thermistor Tmax and the target temperature Ttgt+the difference ΔT. If the CPU 420 ends the control of a power supply amount, the processing returns to step S1104, and the CPU 420 executes next processing based on whether to continue the sheet passing mode.

In step S1108, the CPU 420 ends the sheet passing mode. The description of subsequent processing will be omitted.

As described above, in the present example embodiment, the thermistor Tmax is used as a reference thermistor of the temperature control throughout the start-up mode and the sheet passing mode, and the control target temperature TGT2 of the drive D2 is set based on a difference ΔT between the detected temperature of the thermistor Tmax and the detected temperature of the thermistor Tmin. The difference ΔT is a difference between the detected temperature of the thermistor Tmax and the detected temperature of the thermistor Tmin that is obtained when the detected temperature of the thermistor Tmax reaches the upper limit target temperature Tlim, and the difference ΔT remains constant throughout the sheet passing mode. By executing heater control in this manner, as illustrated in FIG. 13B, the temperatures of the fixing film 202 in the regions TF3 and TF5 in the sheet passing mode can be brought within the range of the fixing temperature margin.

In the present example embodiment, the control target temperature TGT2 of the drive D2 is set based on the difference ΔT between the detected temperature of the thermistor Tmax and the detected temperature of the thermistor Tmin, but the difference ΔT needs not be always used. For example, by using a ratio between the detected temperature of the thermistor Tmax and the detected temperature of the thermistor Tmin, heater control may be executed in such a manner that detected temperatures of the main thermistor TM3 and TM5 fall within the range of the fixing temperature margin. More specifically, the control target temperature TGT2 corrected based on a coefficient corresponding to the detected temperature of the thermistor Tmax and the detected temperature of the thermistor Tmin is set. As an example of control performed in this case, it is assumed that the detected temperature of the thermistor Tmax is equal to 1.1 times of the detected temperature of the thermistor Tmin. At this time, in a case where the main thermistor TM5 is used as a reference thermistor of the temperature control, the control target temperature TGT2 in the sheet passing mode is set to the target temperature Ttgt×1.1 in the present example embodiment.

As an example of control of using a difference ΔT between the detected temperature of the thermistor Tmax and the detected temperature of the thermistor Tmin, in a case where the detected temperature of the thermistor Tmin is equal to a value obtained by subtracting 5° C. from the detected temperature of the thermistor Tmax, control may be performed assuming that the value obtained by subtracting 5° C. from the detected temperature of the thermistor Tmax is the detected temperature of the thermistor Tmin. In this case, in the sheet passing mode, control is performed by setting the target temperature Ttgt to a value obtained by subtracting 5° C. from the detected temperature of the thermistor Tmax.

Furthermore, as an example of control of using a ratio between the detected temperature of the thermistor Tmax and the detected temperature of the thermistor Tmin, in a case where the detected temperature of the thermistor Tmin is equal to 0.9 times of the detected temperature of the thermistor Tmax, control may be performed using a value obtained by multiplying the detected temperature of the thermistor Tmax by 0.9, as the detected temperature of the thermistor Tmin. In this case, in the sheet passing mode, control is performed by setting the target temperature Ttgt to a value obtained by multiplying the detected temperature of the thermistor Tmax by 0.9.

A difference ΔT between the detected temperature of the thermistor Tmax and the detected temperature of the thermistor Tmin, and a ratio between the detected temperature of the thermistor Tmax and the detected temperature of the thermistor Tmin will also be referred to as information regarding a temperature difference between a first detected temperature and a second detected temperature. By comparing information regarding a heat generation amount of a heating block HB corresponding to the thermistor Tmax, and information regarding a heat generation amount of a heating block HB corresponding to the thermistor Tmin, heater control may be performed in such a manner that detected temperatures of the main thermistors TM3 and TM5 are brought within the range of the fixing temperature margin.

The information regarding the heat generation amounts may be values that are based on actual measurement values of detected temperatures of the thermistors Tmax and Tmin that are obtained in a manufacturing process and image formation, or may be values that are based on values of detected temperatures of the thermistors Tmax and Tmin that are predicted by an environmental factor in image formation.

In the second example embodiment, the description has been given of a method of using the thermistor Tmax as a reference thermistor of the temperature control throughout the start-up mode and the sheet passing mode, and setting the control target temperature TGT2 of the drive D2 based on the difference ΔT between the detected temperature of the thermistor Tmax and the detected temperature of the thermistor Tmin. A third example embodiment is different from the second example embodiment in that, as indicated by a thick dotted-line in FIG. 15A, the thermistor Tmin is used as a reference thermistor of the temperature control throughout the start-up mode and the sheet passing mode. In the present example embodiment, the thermistor Tmin is used as a reference thermistor of the temperature control also in the start-up mode. Thus, a difference ΔT between the detected temperature of the thermistor Tmax and the detected temperature of the thermistor Tmin is preliminarily measured in a manufacturing process in such a manner that the detected temperature of the thermistor Tmax does not exceed the upper limit target temperature Tlim in the start-up mode. Then, using the thermistor Tmin as a reference thermistor of the temperature control, the control target temperature TGT2 of the drive D2 is set to the upper limit target temperature Tlim−the difference ΔT. At this time, considering more about safety, using the thermistor Tmin as a reference thermistor of the temperature control, the control target temperature TGT2 of the drive D2 may be set to a temperature lower than the upper limit target temperature Tlim−the difference ΔT.

In a case where a sheet non-passing portion temperature rise occurs in a heating block in which the thermistor Tmax is arranged, a value of a difference ΔT between the detected temperature of the thermistor Tmax and the detected temperature of the thermistor Tmin becomes different from the value of the difference ΔT that has been preliminarily measured in the manufacturing process. If the heater control according to the present example embodiment is executed in this case as well, the detected temperature of the thermistor Tmax sometimes exceeds the excessive temperature rise threshold Ter. Thus, in the present example embodiment, in consideration of safety, the heater control according to the present example embodiment is executed only in a case where a sheet non-passing portion temperature rise does not occur in the thermistor Tmax. For example, after image formation is executed onto a small-sized sheet that can cause a sheet non-passing portion temperature rise, the heater control according to the present example embodiment is not executed.

Hereinafter, the heater control according to the present example embodiment will be described with reference to FIGS. 14, 15A, and 15B. In the following description, the same configurations as those in the first example embodiment are assigned the same numbers, and the description thereof will be omitted.

Figure 14:
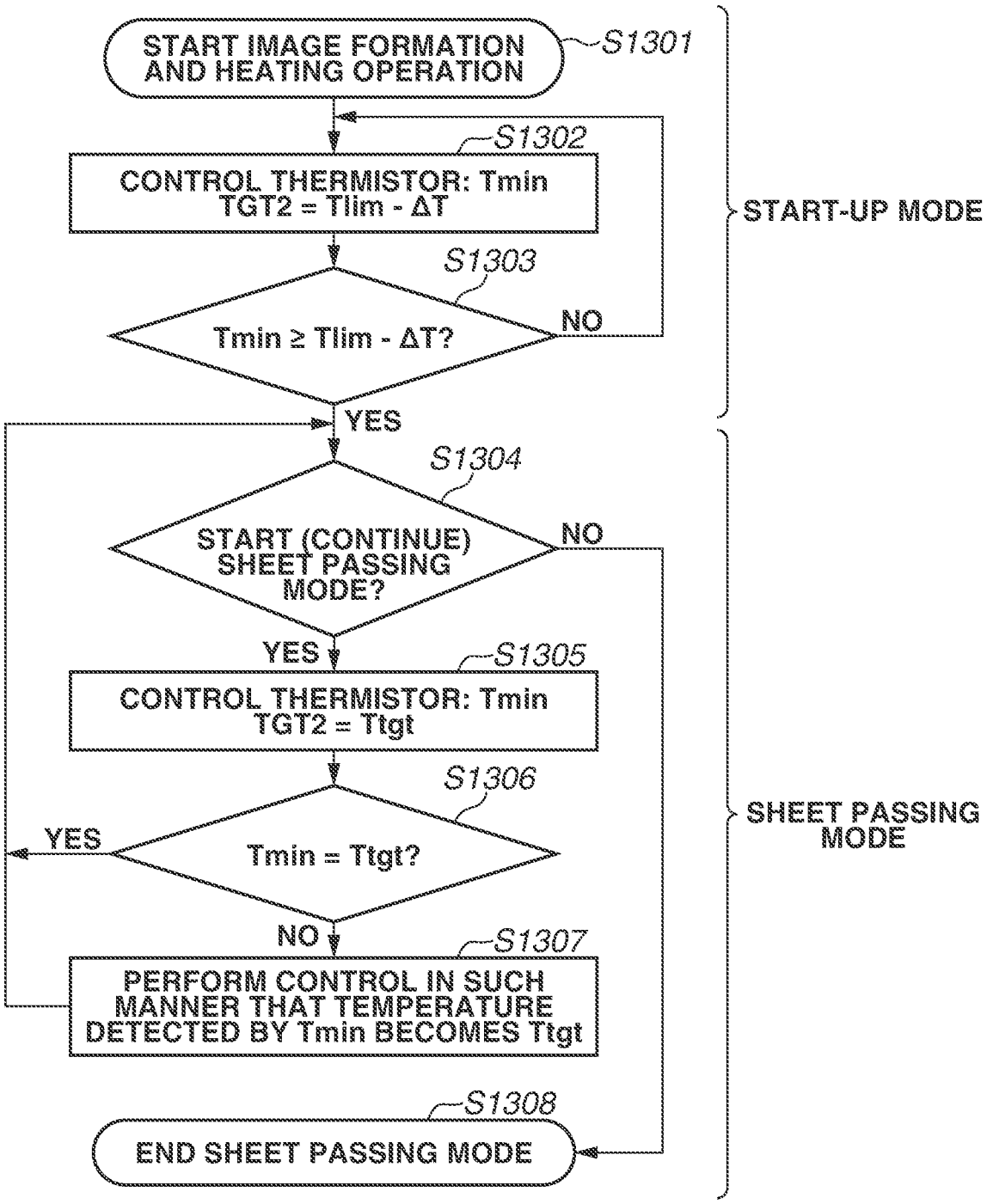
FIG. 14 is a flowchart of processing to be executed by a control unit in heater control according to a third example embodiment.

FIG. 14 is a flowchart of processing to be executed by the CPU 420 in heater control in the same driving group according to the present example embodiment. FIGS. 15A and 15B illustrate temperature transition caused in a case where the heater control according to the present example embodiment is executed in the drive D2. FIG. 15A illustrates transition of detected temperatures of the main thermistor TM3 (broken line) and the main thermistor TM5 (solid line) of the drive D2. Out of the main thermistor TM3 and the main thermistor TM5, the detected temperature of a thermistor selected as a temperature control reference for controlling supplied power to the drive D2 is indicated by a thick line, and the control target temperature TGT2 of the drive D2 is indicated by a thick dashed-dotted line. FIG. 15B illustrates temperature transition in the regions TF3 and TF5 of the fixing film 202 that correspond to the heated regions HZ3 and HZ5.

<Start-Up Mode>

In step S1301, the CPU 420 starts an image forming operation by the engine controller 113 controlling each component included in the image forming apparatus 100 in response to a print start command transmitted from the video controller 120 to the engine controller 113. The CPU 420 starts a heating operation of the image heating apparatus 200 based on the control performed by the engine controller 113. When the CPU 420 starts a heating operation of the image heating apparatus 200, the processing proceeds to step S1302.

In step S1302, the CPU 420 selects, from among main thermistors arranged in the same driving group, a main thermistor Tmin having the lowest detected temperature that has been preliminarily detected in a manufacturing process, as a reference thermistor of the temperature control, and controls supplied power to the same driving group. At this time, the CPU 420 may detect a main thermistor Tmin having the lowest detected temperature among main thermistors arranged in the same driving group, and select the main thermistor Tmin as a reference thermistor of the temperature control. Using the thermistor Tmin as a reference thermistor of the temperature control, the CPU 420 sets the control target temperature TGT2 of the drive D2 to the target temperature Ttgt. More specifically, the CPU 420 selects the main thermistor TM3 (broken line), which is the thermistor Tmin, as a reference thermistor of the temperature control as illustrated in FIG. 15A. At this time, as described above, in a case where the thermistor Tmin is used as a reference thermistor of the temperature control, the CPU 420 controls supplied power to the drive D2 by setting the control target temperature TGT2 of the drive D2 to the upper limit target temperature Tlim−the difference ΔT in such a manner that the detected temperature of the thermistor Tmax does not exceed the upper limit target temperature Tlim. If the CPU 420 selects a reference thermistor of the temperature control and sets the control target temperature TGT2 of the drive D2, the processing proceeds to step S1303.

In step S1303, the CPU 420 determines whether the detected temperature of the thermistor Tmin is a temperature higher than or equal to the upper limit target temperature Tlim−the difference ΔT, for executing next processing. In a case where the CPU 420 determines that the detected temperature of the thermistor Tmin is a temperature higher than or equal to the upper limit target temperature Tlim−the difference ΔT, i.e., in a case where the detected temperature of the main thermistor TM3, which is the thermistor Tmin, has reached the upper limit target temperature Tlim−the difference ΔT (YES in step S1303), the processing proceeds to step S1304. In a case where the detected temperature of the thermistor Tmin is a temperature lower than the upper limit target temperature Tlim−the difference ΔT, i.e., in a case where the detected temperature of the main thermistor TM3, which is the thermistor Tmin, has not reached the upper limit target temperature Tlim−the difference ΔT (NO in step S1303), the processing returns to step S1302.

<Sheet Passing Mode>

In step S1304, the CPU 420 determines whether to start or continue the sheet passing mode. In a case where the sheet passing mode is to be started or continued, (YES in step S1304), the processing proceeds to step S1305. In a case where the sheet passing mode is to be ended (NO in step S1304), the processing proceeds to step S1308.

In step S1305, continuously using the thermistor Tmin as a reference thermistor of the temperature control, the CPU 420 controls supplied power to the same driving group. At this time, using the thermistor Tmin as a reference thermistor of the temperature control, the CPU 420 sets the control target temperature TGT2 of the drive D2 to the target temperature Ttgt.

Figure 15A:
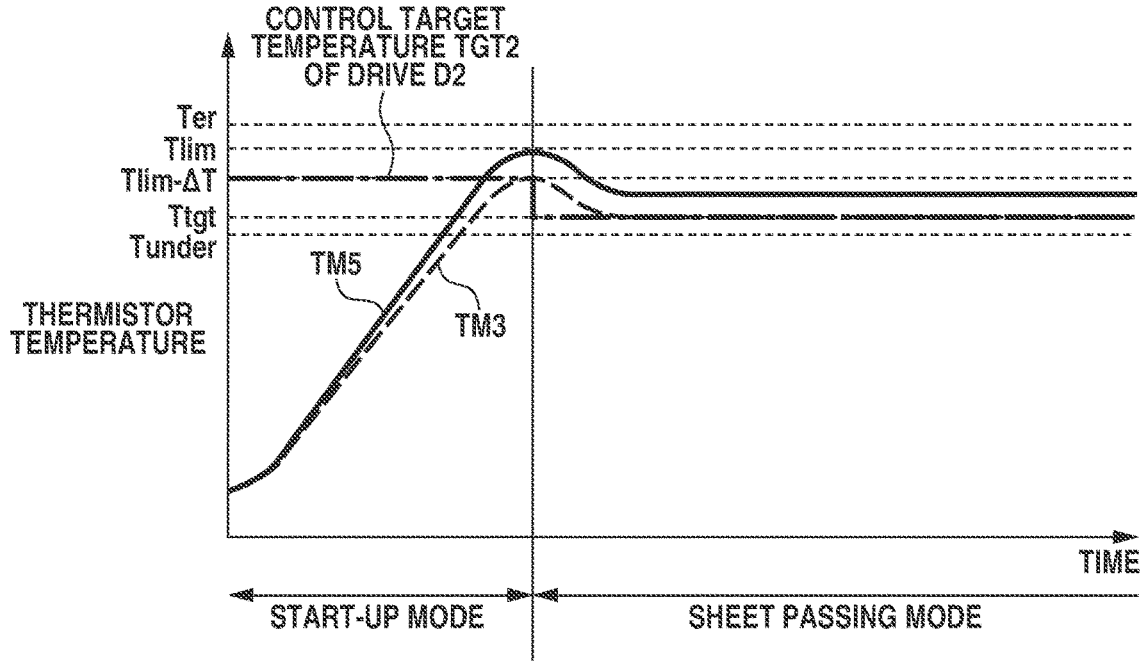
FIGS. 15A and 15B illustrate temperature transition caused in a case where heater control according to the third example embodiment is executed.
Figure 15B:
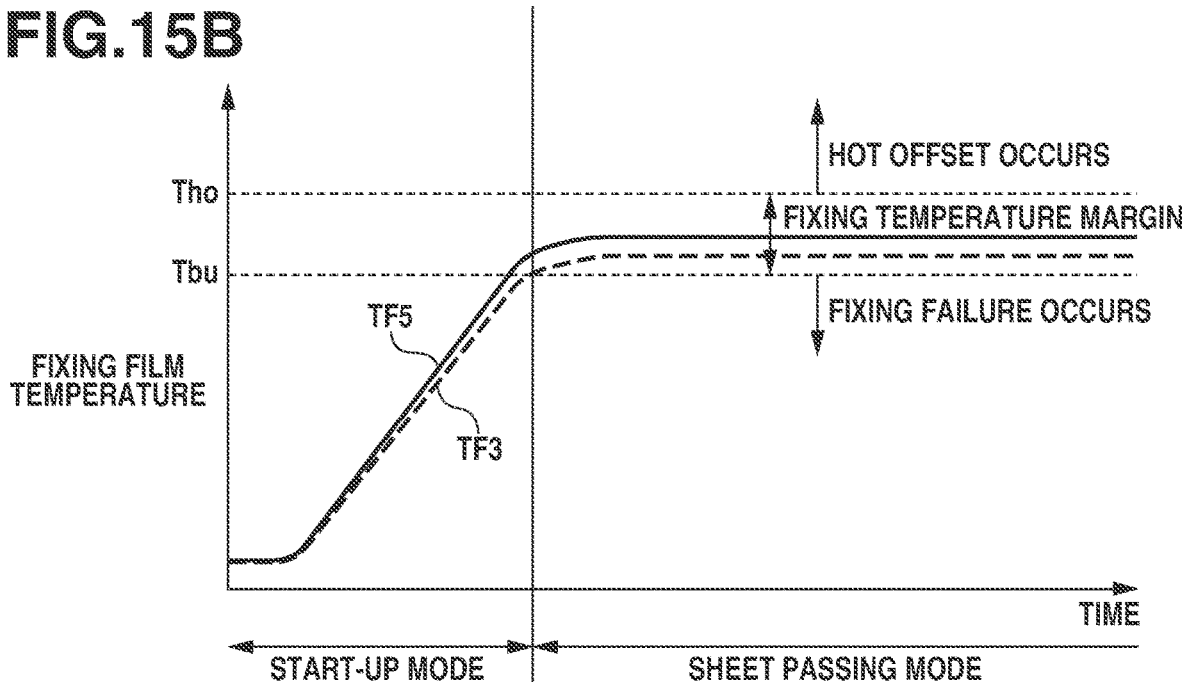

More specifically, the CPU 420 selects the main thermistor TM3 (broken line), which is the thermistor Tmin, as a reference thermistor of the temperature control as illustrated in FIG. 15A, and controls supplied power to the drive D2 by setting the control target temperature TGT2 of the drive D2 to the target temperature Ttgt. When the CPU 420 sets the control target temperature TGT2 of the drive D2, the processing proceeds to step S1306.

In step S1306, the CPU 420 monitors detected temperatures of the main thermistors arranged in the same driving group, throughout the sheet passing mode, and determines whether the detected temperature of the thermistor Tmin is a temperature equal to the target temperature Ttgt, for executing next processing. In a case where the CPU 420 determines that the detected temperature of the thermistor Tmin is a temperature equal to the target temperature Ttgt, i.e., in a case where the detected temperature of the main thermistor TM3, which is the thermistor Tmin, is a temperature equal to the target temperature Ttgt (YES in step S1306), the processing returns to step S1304, and the CPU 420 executes next processing based on whether to continue the sheet passing mode. In a case where the detected temperature of the thermistor Tmin is not a temperature equal to the target temperature Ttgt, i.e., in a case where the detected temperature of the main thermistor TM3, which is the thermistor Tmin, is not a temperature equal to the target temperature Ttgt (NO in step S1306), the processing proceeds to step S1307.

In step S1307, the CPU 420 controls a detected temperature of the thermistor Tmin to become the target temperature Ttgt. As an example of the processing performed at this time, in a case where the detected temperature of the thermistor Tmin is higher than the target temperature Ttgt, a power supply amount is decreased based on a difference between the detected temperature of the thermistor Tmin and the target temperature Ttgt. In a case where the detected temperature of the thermistor Tmin is lower than the target temperature Ttgt, a power supply amount is increased based on a difference between the detected temperature of the thermistor Tmin and the target temperature Ttgt. If the CPU 420 ends the control of a power supply amount, the processing returns to step S1304, and the CPU 420 executes next processing based on whether to continue the sheet passing mode.

In step S1308, the CPU 420 ends the sheet passing mode. The description of subsequent processing will be omitted.

As described above, in the present example embodiment, the thermistor Tmin is used as a reference thermistor of the temperature control throughout the start-up mode and the sheet passing mode, and the control target temperature TGT2 of the drive D2 is set based on a difference ΔT between the detected temperature of the thermistor Tmax and the detected temperature of the thermistor Tmin. The difference ΔT is a difference between the detected temperature of the thermistor Tmax and the detected temperature of the thermistor Tmin that is obtained when the detected temperature of the thermistor Tmax reaches the upper limit target temperature Tlim, and the difference ΔT remains constant throughout the sheet passing mode. By executing heater control in this manner, as illustrated in FIG. 15B, the temperatures of the fixing film 202 in the regions TF3 and TF5 in the sheet passing mode can be brought within the range of the fixing temperature margin.

In the present example embodiment, the control target temperature TGT2 of the drive D2 is set based on the difference ΔT between the detected temperature of the thermistor Tmax and the detected temperature of the thermistor Tmin, but the difference ΔT needs not be always used. For example, by using a ratio between the detected temperature of the thermistor Tmax and the detected temperature of the thermistor Tmin, heater control may be executed in such a manner that detected temperatures of the main thermistor TM3 and TM5 fall within the range of the fixing temperature margin. More specifically, the control target temperature TGT2 corrected based on a coefficient corresponding to the detected temperature of the thermistor Tmax and the detected temperature of the thermistor Tmin is set. As an example of control performed in this case, it is assumed that the detected temperature of the thermistor Tmax is equal to 1.1 times of the detected temperature of the thermistor Tmin. At this time, in a case where the main thermistor TM3 is used as a reference thermistor of the temperature control, the control target temperature TGT2 in the start-up mode is set to the upper limit target temperature Tlim×0.9 in the present example embodiment. A difference ΔT between the detected temperature of the thermistor Tmax and the detected temperature of the thermistor Tmin, and a ratio between the detected temperature of the thermistor Tmax and the detected temperature of the thermistor Tmin will also be referred to as information regarding a temperature difference between a first detected temperature and a second detected temperature.

As an example of control of using a difference ΔT between the detected temperature of the thermistor Tmax and the detected temperature of the thermistor Tmin, in a case where the detected temperature of the thermistor Tmax is equal to a value obtained by adding 5° C. to the detected temperature of the thermistor Tmin, control may be performed assuming that the value obtained by adding 5° C. to the detected temperature of the thermistor Tmin is the detected temperature of the thermistor Tmax. In this case, in the start-up mode, control is performed by setting the upper limit target temperature Tlim to the value obtained by adding 5° C. to the detected temperature of the thermistor Tmin.

Furthermore, as an example of control of using a ratio between the detected temperature of the thermistor Tmax and the detected temperature of the thermistor Tmin, in a case where the detected temperature of the thermistor Tmax is equal to 1.1 times of the detected temperature of the thermistor Tmin, control may be performed using a value obtained by multiplying the detected temperature of the thermistor Tmin by 1.1, as the detected temperature of the thermistor Tmax. In this case, in the start-up mode, control is performed by setting the upper limit target temperature Tlim to the value obtained by multiplying the detected temperature of the thermistor Tmin by 1.1.

A difference ΔT between the detected temperature of the thermistor Tmax and the detected temperature of the thermistor Tmin, and a ratio between the detected temperature of the thermistor Tmax and the detected temperature of the thermistor Tmin will also be referred to as information regarding a temperature difference between a first detected temperature and a second detected temperature. By comparing information regarding a heat generation amount of a heating block HB corresponding to the thermistor Tmax, and information regarding a heat generation amount of a heating block HB corresponding to the thermistor Tmin, heater control may be performed in such a manner that detected temperatures of the main thermistors TM3 and TM5 are brought within the range of the fixing temperature margin.

The information regarding the heat generation amounts may be values that are based on actual measurement values of detected temperatures by the thermistors Tmax and Tmin that are obtained in a manufacturing process and image formation, or may be values that are based on values of detected temperatures by the thermistors Tmax and Tmin that are predicted by an environmental factor in image formation.

In a fourth example embodiment, the description will be given of a case where a heat generation amount of the heating block HB5 is larger than that of the heating block HB3, asymmetric sheet passing of small-sized recording materials is performed immediately before heater control, and heater control according to the present example embodiment is applied in a state where the influence of an asymmetric sheet non-passing portion temperature rise remains in the longitudinal direction. The asymmetric sheet passing refers to executing image formation by arranging small-sized recording materials in the sheet feeding cassette 15A in a state where a central position (not illustrated) in the longitudinal direction of the recording materials is shifted leftward or rightward from the conveyance reference position X. In the present example embodiment, the description will be given of a case where B5 size sheets are arranged in contact with a regulation plate (not illustrated) provided on the right side in the longitudinal direction of the sheet feeding cassette 15A, immediately before the heater control, and image formation is executed in a state where the heated region HZ3 corresponds to a sheet non-passing portion and the heated region HZ5 corresponds to a sheet passing portion.

Figure 16A:
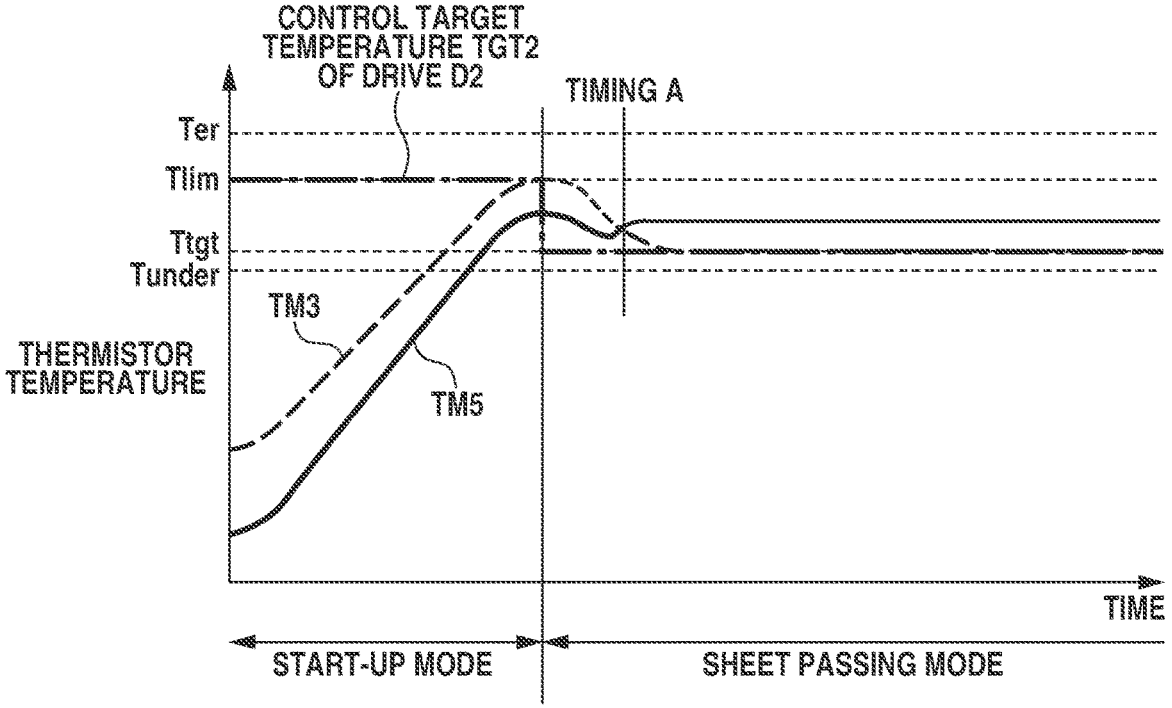
FIGS. 16A and 16B illustrate temperature transition caused in a case where heater control according to a fourth example embodiment is executed.
Figure 16B:
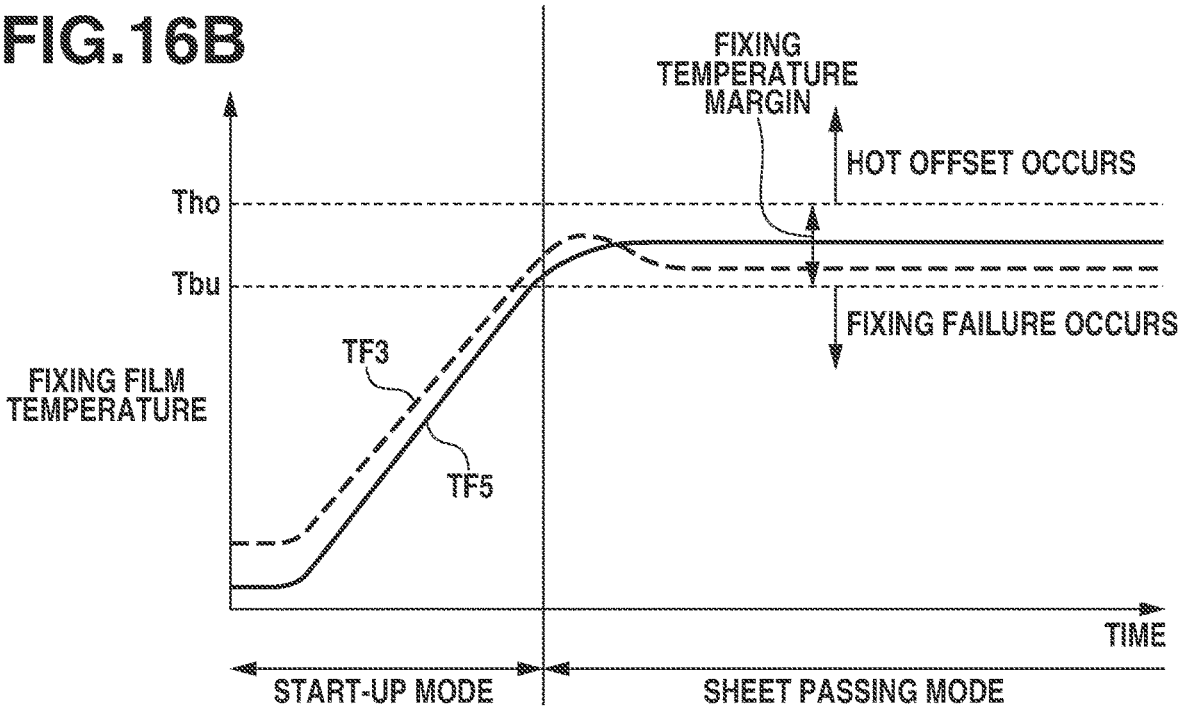

FIGS. 16A and 16B illustrate temperature transition caused in a case where heater control according to the present example embodiment is executed in the drive D2. FIG. 16A according to the present example embodiment illustrates transition of detected temperatures of the main thermistor TM3 (broken line) and the main thermistor TM5 (solid line) of the drive D2. Out of the main thermistor TM3 and the main thermistor TM5, a detected temperature of a thermistor selected as a reference for controlling supplied power to the drive D2 is indicated by a thick line, and the control target temperature TGT2 of the drive D2 is indicated by a thick dashed-dotted line. FIG. 16B illustrates temperature transition in the regions TF3 and TF5 of the fixing film 202 that correspond to the heated regions HZ3 and HZ5.

As illustrated in FIG. 16A, image formation is started in a state where the detected temperature of the main thermistor TM3 is higher than the detected temperature of the main thermistor TM5. For a certain period of time from the start of image formation, a state where the detected temperature of the main thermistor TM3 is higher than the detected temperature of the main thermistor TM5 continues due to the influence of a sheet non-passing portion temperature rise. After that, when the first recording material P reaches the fixing nip portion N, a temperature difference caused by a resistance variation between heating blocks gradually becomes larger than a temperature difference caused by a sheet non-passing portion temperature rise, and the detected temperature of the main thermistor TM5 becomes higher than the detected temperature of the main thermistor TM3.

Subsequently, heater control to be executed by the CPU 420 depending on the temperature transition of main thermistors as illustrated in FIG. 16A will be described while selectively extracting processing of heater control illustrated in the flowchart of FIG. 8.

<Start-Up Mode>

In step S602, because the detected temperature of the main thermistor TM3 is higher than the detected temperature of the main thermistor TM5, the CPU 420 selects the main thermistor TM3 (broken line), which is the thermistor Tmax, as a reference thermistor, and controls supplied power to the drive D2 by setting the control target temperature TGT2 of the drive D2 to the upper limit target temperature Tlim. The CPU 420 can thereby control detected temperatures not to exceed the excessive temperature rise threshold Ter. When the CPU 420 selects a reference thermistor and sets the control target temperature TGT2 of the drive D2, the processing proceeds to step S603.

In step S603, the CPU 420 determines whether the detected temperature of the thermistor Tmax is a temperature higher than or equal to the upper limit target temperature Tlim. In a case where the CPU 420 determines that the detected temperature of the thermistor Tmax is a temperature higher than or equal to the upper limit target temperature Tlim, i.e., in a case where the detected temperature of the main thermistor TM3, which is the thermistor Tmax, has reached the upper limit target temperature Tlim (YES in step S603), the processing proceeds to step S604, and the control mode shifts to the sheet passing mode.

<Sheet Passing Mode>

In step S604, the CPU 420 determines whether to start or continue the sheet passing mode. In a case where the sheet passing mode is to be started or continued, (YES in step S604), the processing proceeds to step S605. In a case where the sheet passing mode is to be ended (NO in step S604), the processing proceeds to step S608.

In step S605, because the detected temperature of the main thermistor TM5 becomes lower than the detected temperature of the main thermistor TM3, the CPU 420 selects the main thermistor TM5 (solid line), which is the thermistor Tmin, as a reference thermistor, and controls supplied power to the drive D2. Using the thermistor Tmin as a reference thermistor, the CPU 420 sets the control target temperature TGT2 of the drive D2 to the target temperature Ttgt. If the CPU 420 selects a reference thermistor of the temperature control and sets the control target temperature TGT2 of the drive D2, the processing proceeds to step S606.

In step S606, the CPU 420 monitors detected temperatures of the main thermistors arranged in the same driving group, and determines whether the detected temperature of the thermistor Tmin is a temperature equal to the target temperature Ttgt, for executing next processing. In a case where the CPU 420 determines that the detected temperature of the thermistor Tmin is a temperature equal to the target temperature Ttgt (YES in step S606), the processing returns to step S604, and the CPU 420 executes next processing based on whether to continue the sheet passing mode. In a case where the detected temperature of the thermistor Tmin is not a temperature equal to the target temperature Ttgt (NO in step S606), the processing proceeds to step S607. In the present example embodiment, at a timing A in FIG. 16A, the detected temperature of the main thermistor TM3 falls below the detected temperature of the main thermistor TM5, and a magnitude relationship of temperatures is reversed. Thus, the CPU 420 selects the main thermistor TM3 (broken line) as a thermistor Tmin as a reference thermistor, and controls supplied power to the drive D2.

An image forming operation and a heating operation continue also in the processing in step S606 and subsequent steps. In the present example embodiment, the description thereof will be omitted.

In this manner, in the present example embodiment, the thermistor Tmax is used as a reference thermistor by a control unit in the start-up mode, and the thermistor Tmin is used as a reference thermistor by a control unit in the sheet passing mode. In the present example embodiment, the CPU 420 selects thermistors Tmax and Tmin based on the detected temperatures of main thermistors. By executing heater control in this manner, as illustrated in FIG. 16B, the temperatures of the fixing film 202 in the regions TF3 and TF5 in the sheet passing mode can be brought within the range of the fixing temperature margin.

Other Example Embodiments

In the first to fourth example embodiments, the description has been given of an example of a state where a resistance value of the heating block HB5 is smaller than that of the heating block HB3, and a heat generation amount of the heating block HB5 is larger than that of the heating block HB3. However, in the present example embodiment, it is not limited thereto. For example, a heat generation amount of the heating block HB3 may be larger than that of the heating block HB5. At this time, in a case where the CPU 420 executes control similar to that in the first example embodiment, in the start-up mode, the main thermistor TM3, which is the thermistor Tmax, is selected as a reference thermistor. In the sheet passing mode, the main thermistor TM5, which is the thermistor Tmin, is selected as a reference thermistor.

Furthermore, in the first example embodiment, a timing at which a thermistor used for controlling the same driving group is switched from the thermistor Tmax to the thermistor Tmin (a timing at which the control mode shifts from the start-up mode to the sheet passing mode) is set to the same timing as a timing at which a control target temperature is switched from the upper limit target temperature Tlim to the target temperature Ttgt. The switch timing needs not be always limited to this timing. For example, the switch timing may be set to a timing at which the first recording material P reaches the fixing nip portion N.

In the first to fourth example embodiments, the sub thermistors TS2 to TS6 are not used for controlling supplied power, but thermistors Tmax and Tmin may be selected from among thermistors including these thermistors.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2020-204446, filed Dec. 9, 2020, which is hereby incorporated by reference herein in its entirety.

What is claimed is:

1. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, based on a first detected temperature detected by the first temperature detection member or a second detected temperature detected by the second temperature detection member, wherein, in a case where a period from a start of power supply to the common power supply path until one of the first detected temperature and the second detected temperature reaches a first temperature is defined as a first period, and a period for the heater heating a recording material that is later than the first period is defined as a second period, the control unit controls power to be supplied to the common power supply path in the first period, using the selected first temperature detection member, and controls power to be supplied to the common power supply path in the second period, using the selected second temperature detection member, the first temperature detection member has a higher detected temperature than that of the second temperature detection member, in the second period, the first detected temperature and the second detected temperature fall within a temperature range between the first temperature and a second temperature lower than the first temperature, and wherein the control unit controls power to be supplied to the common power supply path, by selecting, in the first period, the first temperature detection member having the higher detected temperature out of the first temperature detection member and the second temperature detection member, and selecting, in the second period, the second temperature detection member having a lower detected temperature out of the first temperature detection member and the second temperature detection member.

2. The image heating apparatus according to claim 1, wherein, in the second period, the control unit controls the second detected temperature to be a third temperature that is a temperature lower than the first temperature and higher than the second temperature, in such a manner that both the first detected temperature and the second detected temperature do not fall below the second temperature.

3. The image heating apparatus according to claim 2, wherein, in the first period, the control unit rises a temperature of the heater by controlling power to be supplied to the common power supply path, in such a manner that the detected temperature detected by a temperature detection member having a higher detected temperature becomes the first temperature, and in the second period, brings the first detected temperature and the second detected temperature within a temperature range between the first temperature and the second temperature, by controlling power to be supplied to the common power supply path, in such a manner that the detected temperature detected by a temperature detection member having a lower detected temperature becomes the third temperature.

4. The image heating apparatus according to claim 1, further comprising a storage unit configured to store the first temperature detection member having the higher detected temperature out of the first temperature detection member and the second temperature detection member having a lower detected temperature out of the first temperature detection member and the second temperature detection member, wherein, in the first period, the control unit controls power to be supplied to the common power supply path, using the first temperature detection member having the higher detected temperature that is stored in the storage unit, and wherein, in the second period, the control unit controls power to be supplied to the common power supply path, using the second temperature detection member having the lower detected temperature that is stored in the storage unit.

5. The image heating apparatus according to claim 1, further comprising:

a film having a cylindrical shape; and a roller configured to contact an outer circumferential surface of the film, wherein the heater is arranged in an internal space of the film, the film is nipped by the heater and the roller, and an image on a recording material is heated via the film at a nip portion formed between the film and the roller.

6. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, and wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on the first detected temperature, and controls power to be supplied to the common power supply path in the second period, based on information regarding a temperature difference between the first detected temperature and a second detected temperature detected by the second temperature detection member, and the first detected temperature, in the second period, the first detected temperature and the second detected temperature fall within a temperature range between the first temperature and a second temperature lower than the first temperature, and wherein the control unit controls power to be supplied to the common power supply path, in such a manner that, in the second period, the first detected temperature becomes a temperature obtained by adding a temperature difference between the first detected temperature and the second detected temperature to a third temperature that is a temperature lower than the first temperature and higher than the second temperature.

7. The image heating apparatus according to claim 6, further comprising:

a film having a cylindrical shape; and a roller configured to contact an outer circumferential surface of the film, wherein the heater is arranged in an internal space of the film, the film is nipped by the heater and the roller, and an image on a recording material is heated via the film at a nip portion formed between the film and the roller.

8. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on the first detected temperature, and controls power to be supplied to the common power supply path in the second period, based on information regarding a temperature difference between the first detected temperature and a second detected temperature detected by the second temperature detection member, and the first detected temperature, in the second period, the first detected temperature and the second detected temperature fall within a temperature range between the first temperature and a second temperature lower than the first temperature, and wherein the control unit controls power to be supplied to the common power supply path, in such a manner that, in the second period, the first detected temperature becomes a temperature obtained by correcting a third temperature that is a temperature lower than the first temperature and higher than the second temperature, based on a coefficient corresponding to a temperature difference between the first detected temperature and the second detected temperature.

9. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on the first detected temperature, and controls power to be supplied to the common power supply path in the second period, based on information regarding a temperature difference between the first detected temperature and a second detected temperature detected by the second temperature detection member, and the first detected temperature, in the second period, the first detected temperature and the second detected temperature fall within a temperature range between the first temperature and a second temperature lower than the first temperature, and wherein the control unit controls power to be supplied to the common power supply path, in such a manner that, in the second period, a temperature obtained by correcting the first detected temperature based on a coefficient corresponding to a temperature difference between the first detected temperature and the second detected temperature becomes a third temperature.

10. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on information regarding a temperature difference between the first detected temperature and a second detected temperature detected by the second temperature detection member, and the second detected temperature, and controls power to be supplied to the common power supply path in the second period, based on the second detected temperature, and in the second period, the second detected temperature falls within a temperature range between the first temperature and a second temperature lower than the first temperature, and wherein the control unit controls power to be supplied to the common power supply path, in such a manner that, in the first period, the second detected temperature becomes a temperature obtained by correcting the first temperature based on a coefficient corresponding to a temperature difference between the first detected temperature and the second detected temperature.

11. The image heating apparatus according to claim 10, further comprising:

a film having a cylindrical shape; and a roller configured to contact an outer circumferential surface of the film, wherein the heater is arranged in an internal space of the film, the film is nipped by the heater and the roller, and an image on a recording material is heated via the film at a nip portion formed between the film and the roller.

12. An image heating apparatus for heating an image formed on a recording material, the image heating apparatus comprising:

a heater in which a plurality of heating blocks including a first heating block and a second heating block is arranged in a direction orthogonal to a conveyance direction of a recording material;

a first temperature detection member configured to detect a temperature of the first heating block;

a second temperature detection member configured to detect a temperature of the second heating block; and a control unit configured to control power supply to the plurality of heating blocks, wherein the first heating block and the second heating block are electrically connected to a common power supply path, wherein the control unit controls power to be supplied to the common power supply path, wherein, in a case where a period from a start of power supply to the common power supply path until a first detected temperature detected by the first temperature detection member reaches a first temperature is defined as a first period, and a period for the heater heating a recording material that is later than the first period is defined as a second period, the control unit controls power to be supplied to the common power supply path in the first period, based on information regarding a temperature difference between the first detected temperature and a second detected temperature detected by the second temperature detection member, and the second detected temperature, and controls power to be supplied to the common power supply path in the second period, based on the second detected temperature, in the second period, the second detected temperature falls within a temperature range between the first temperature and a second temperature lower than the first temperature, and wherein the control unit controls power to be supplied to the common power supply path, in such a manner that, in the first period, a temperature obtained by correcting the second detected temperature based on a coefficient corresponding to a temperature difference between the first detected temperature and the second detected temperature becomes the first temperature.

* * * * *